US008703370B2

(12) United States Patent
Zhang et al.

(10) Patent No.: US 8,703,370 B2
(45) Date of Patent: Apr. 22, 2014

(54) ELECTROPHOTOGRAPHIC PHOTORECEPTOR, MANUFACTURING METHOD THEREFOR AND ELECTROPHOTOGRAPHIC DEVICE

(75) Inventors: Quanqiu Zhang, Matsumoto (JP); Shinjiro Suzuki, Matsumoto (JP); Yoichi Nakamura, Matsumoto (JP)

(73) Assignee: Fuji Electric Co., Ltd., Kawasaki-Shi (JP)

( * ) Notice: Subject to any disclaimer, the term of this patent is extended or adjusted under 35 U.S.C. 154(b) by 41 days.

(21) Appl. No.: 13/521,737

(22) PCT Filed: Jan. 27, 2011

(86) PCT No.: PCT/JP2011/051665

§ 371 (c)(1),
(2), (4) Date: Aug. 22, 2012

(87) PCT Pub. No.: WO2011/093410

PCT Pub. Date: Aug. 4, 2011

(65) Prior Publication Data

US 2013/0040234 A1 Feb. 14, 2013

(30) Foreign Application Priority Data

Jan. 29, 2010 (WO) ..... PCT/JP2010/051264

(51) Int. Cl.

| | |
|---|---|
| ***G03G 5/04*** | (2006.01) |
| ***G03G 5/05*** | (2006.01) |
| ***G03G 5/02*** | (2006.01) |

(52) U.S. Cl.

CPC ..... *G03G 5/0578* (2012.01); *G03G 5/056* (2013.01); *G03G 5/0564* (2013.01); *G03G 5/0211* (2013.01); *G03G 5/0592* (2013.01); *G03G 5/0525* (2013.01)

USPC ..... 430/58.05; 430/127

(58) Field of Classification Search

CPC combination set(s) only.
See application file for complete search history.

(56) References Cited

U.S. PATENT DOCUMENTS

| | | | | |
|---|---|---|---|---|
| 2008/0286673 | A1* | 11/2008 | Kuboshima et al. | 430/74 |
| 2009/0087761 | A1 | 4/2009 | Fukushima et al. | |

FOREIGN PATENT DOCUMENTS

| | | | |
|---|---|---|---|
| JP | 61-062040 | A | 3/1986 |
| JP | 01-205171 | A | 8/1989 |
| JP | 04-368953 | A | 12/1992 |
| JP | 05-113670 | A | 5/1993 |
| JP | 07-333881 | A | 12/1995 |
| JP | 08-234468 | A | 9/1996 |
| JP | 11-130857 | A | 5/1999 |
| JP | 11-279274 | A | 10/1999 |
| JP | 11-282182 | A | 10/1999 |
| JP | 2001-100441 | A | 4/2001 |
| JP | 2002-128883 | A | 5/2002 |
| JP | 2002-162759 | A | 6/2002 |
| JP | 2002-333730 | A | 11/2002 |
| JP | 2007-199659 | A | 8/2007 |
| JP | 2008-175980 | A | 7/2008 |
| JP | 2009-098675 | A | 5/2009 |

* cited by examiner

*Primary Examiner* — Peter Vajda
(74) *Attorney, Agent, or Firm* — Rabin & Berdo, P.C.

(57) ABSTRACT

An electrophotographic photoreceptor includes a conductive substrate; and a photosensitive layer provided on the conductive substrate and containing a resin binder that is a polycarbonate resin having structural units represented by General Formulae (1) and (2). The electrophotographic photoreceptor reduces the amount of wear and provides good images while maintaining a low frictional resistance on the surface of a photoreceptor drum from the beginning until after printing. A method for manufacturing such an electrophotographic photoreceptor includes applying a coating liquid containing at least such a resin binder onto a conductive substrate to thereby form a photosensitive layer. An electrophotographic device is disclosed that is equipped with such an electrophotographic photoreceptor.

10 Claims, 2 Drawing Sheets

ELECTROPHOTOGRAPHIC PHOTORECEPTOR, MANUFACTURING METHOD THEREFOR AND ELECTROPHOTOGRAPHIC DEVICE

BACKGROUND OF THE INVENTION

1. Field of the Invention

The present invention relates to an electrophotographic photoreceptor (hereunder sometimes called simply a "photoreceptor"), to a manufacturing method therefor and to an electrophotographic device, and relates specifically to an electrophotographic photoreceptor that is formed principally of a conductive substrate and a photosensitive layer containing an organic material, and is used in electrophotographic printers, copiers, fax machines and the like, and to a manufacturing method therefor and an electrophotographic device.

2. Background of the Related Art

The basic structure of an electrophotographic photoreceptor comprises a photosensitive layer with a photoconductive function on a conductive substrate. In recent years, organic electrophotographic photoreceptors using organic compounds as functional components for producing and transporting charge have been subjects of active research and development because of their diversity of materials, high productivity and safety among other advantages, and they are being applied to copiers, printers and the like.

In general, a photoreceptor must have the function of holding a surface charge in a dark place, the function of receiving light and generating charge, and also the function of transporting the generated charge. Such photoreceptors include monolayer photoreceptors provided with a monolayer photosensitive layer having all these functions, and stacked (functionally separated) photoreceptors provided with a photosensitive layer comprising a stack of functionally discrete layers: primarily, a charge generating layer that serves the function of generating charge during photoreception and a charge transport layer that serves the functions of holding a surface charge in a dark place and transporting the charge generated in the charge generating layer during photoreception.

The photosensitive layer is normally formed by dissolving or dispersing a charge generating material, a charge transport material and a resin binder in an organic solvent to obtain a coating liquid that is then applied to a conductive substrate. In these organic electrophotographic photoreceptors, polycarbonates that are highly flexible, transparent to light exposure and resistant to friction with the paper and the blade used for toner removal are often used as resin binders in the layer forming the outermost surface in particular. Of these, bisphenol Z polycarbonate is widely used as a resin binder. Techniques using this polycarbonate as a resin binder are described for example in Japanese Patent Application Laid-open No. S61-62040 and the like.

Currently, most electrophotographic devices are so-called digital devices using a monochromatic exposing source such as an argon, helium-neon or semiconductor laser or a light-emitting diode, whereby images, words and other information are digitalized and converted to an optical signal, and exposed on a electrically charged photoreceptor to thereby form an electrostatic latent image that is then developed with toner.

Methods of charging the photoreceptor include non-contact charging systems using scorotrons and other charge devices that do not contact the photoreceptor, and contact charging systems using charge devices with semiconductive rubber rollers and brushes that do contact the photoreceptor. The advantage of a contact charging system over a non-contact charging system is that little ozone is generated because the corona discharge occurs very near the photoreceptor, so that little applied voltage is required. Thus, this system is favored in medium-sized and small devices in particular because it provides an electrophotographic device that is compact, inexpensive and environmentally friendly.

The most common methods for cleaning the photoreceptor surface include scraping with a blade and simultaneous developing/cleaning processes. In the case of blade cleaning, untransferred residual toner on the surface of the organic photoreceptor is scraped off with a blade, and the toner can then be collected in a waste toner box or returned to the developing machine. The difficulty with cleaning by this blade scraping system is that space is required for the toner collection box and recycling, and it is necessary to monitor the amount of toner in the toner collection box. If paper dust and external additives accumulate on the blade, moreover, they can damage the surface of the organic photoreceptor, shortening the life of the electrophotographic photoreceptor. Thus, the toner is sometimes collected in the developing process, or a means for magnetically or electrically suctioning residual toner adhering to the surface of the electrophotographic photoreceptor is installed immediately before the developing roller.

When using a cleaning blade, moreover, the rubber hardness and contact pressure must be increased in order to improve the cleaning properties. This promotes wear of the photoreceptor, causing fluctuations in potential and sensitivity, and leading to image abnormalities and problems of color balance and reproducibility in the case of color devices.

In the case of a cleaningless system in which development and cleaning are performed together by a developing device using a contact charging mechanism, toner with a fluctuating charge quantity is produced in the contact charging mechanism. Another problem is that when the toner is contaminated by a small quantity of reverse-polarity toner, these toners cannot be sufficiently removed from the photoreceptor, and contaminate the charging device.

The surface of the photoreceptor may also be contaminated by ozone, nitrogen oxides and the like produced during charging of the photoreceptor. In addition to image deletion caused by the contaminants themselves, adhering substances may reduce the lubricity of the surface, making it easier for paper dust and toner to adhere to the surface and cause blade noise, burr, surface scratches and the like among other problems.

In order to increase the transfer efficiency of the toner during the transfer step, moreover, attempts have been made to improve transfer efficiency and reduce residual toner by optimizing the transfer current for the properties of the paper and the temperature and humidity environment. As a result, organic photoreceptors with improved toner release properties and organic photoreceptors with reduced transfer effect are needed as organic photoreceptors suited to such processes and contact charging systems.

To resolve these problems, various methods have been proposed for improving the outermost layers of photoreceptors. For example, Japanese Patent Application Laid-open No. H1-205171 and Japanese Patent Application Laid-open No. H7-333881 propose methods for adding fillers to the photoreceptor surface layer in order to improve the durability of the photoreceptor surface. However, it is difficult to disperse the fillers uniformly with these methods of dispersing the filler in the film. Filler aggregates also occur, film transparency is reduced, and the filler scatters the exposure light, causing irregularities of charge transport and charge generation and detracting from the image characteristics. One method of improving filler dispersibility is to add a dispersant, but in this case the dispersant affects the photoreceptor characteristics, which are difficult to reconcile with filler dispersibility.

In the method disclosed in Japanese Patent Application Laid-open No. H4-368953, polytetrafluoroethylene (PTFE) powder or other fluorine resin powder is included in the photosensitive layer. In the method disclosed in Japanese Patent Application Laid-open No. 2002-162759, an alkyl denatured polysiloxane or other silicone resin is added to the outermost layer of the photoreceptor. However, in the method of Japanese Patent Application Laid-open No. H4-368953 the PTFE powder or other fluorine resin powder has poor solubility in the solvent or poor compatibility with other resins, causing phase separation and light scattering at the resin boundary. Therefore, the sensitivity characteristics have not been adequate for a photoreceptor. In the method of Japanese Patent Application Laid-open No. 2002-162759, the problem has been that continuous effects are not obtained because the silicone resin bleeds on the surface of the coating film.

To solve these problems, Japanese Patent Application Laid-open No. 2002-128883 proposes a method for improving wear resistance whereby a resin having a polysiloxane structure added to the terminal structures is used in the photosensitive layer. Japanese Patent Application Laid-open No. 2007-199659 proposes a photoreceptor containing a polycarbonate or polyallylate made of a phenol raw material containing a specific siloxane structure. Japanese Patent Application Laid-open No. 2002-333730 proposes a photoreceptor containing a polysiloxane compound comprising carboxyl groups in a resin structure. Japanese Patent Application Laid-open No. H5-113670 proposes a photoreceptor in which the photosensitive layer uses a polycarbonate the surface energy of which has been reduced by the inclusion of a silicone structure. Japanese Patent Application Laid-open No. H8-234468 proposes a photoreceptor containing a polyester resin comprising polysiloxane structural units. Further, Japanese Patent Application Laid-open No. 2009-098675 proposes a photoreceptor using an electrophotographic photoreceptor resin composition containing a polycarbonate resin and a polysiloxane group-containing A-B block copolymer with a specific structure as a resin binder, but when added as a polysiloxane group-containing copolymer, this copolymer tends to segregate in the surface layer of the photoreceptor, and it has been difficult to ensure a lasting low-friction coefficient.

Methods have also been proposed for forming surface protective layers on the photosensitive layer with the aim of protecting the photosensitive layer and improving mechanical strength and surface lubricity. The problems with these methods of forming surface protective layers have been the difficulty of forming a film on a charge transport layer, and the difficulty of achieving both charge transport characteristics and charge retention functions.

Thus, various techniques have already been proposed for improving photoreceptors. However, the techniques described in these patent documents have not been adequate for maintaining continuously low friction resistance of the photoreceptor drum surface from the beginning until after printing, or for maintaining good electrical characteristics and image characteristics.

It is therefore an object of the present invention to provide an electrophotographic photoreceptor capable of reducing an amount of wear and providing good images while maintaining low friction resistance on the surface of a photoreceptor drum from the beginning until after printing, along with a manufacturing method therefor and an electrophotographic device.

SUMMARY OF THE INVENTION

To resolve these problems, the inventors perfected the present invention after exhaustive research into resin binders for use in the photosensitive layer, upon discovering that an electrophotographic photoreceptor having a continuous low friction coefficient of the photoreceptor surface and providing both low wear and a low friction coefficient together with excellent electrical characteristics could be achieved by using as the resin binder a binder with a low friction coefficient, which is a polycarbonate resin containing a specific siloxane structure.

That is, the electrophotographic photoreceptor of the present invention has a photosensitive layer on a conductive substrate, and the photosensitive layer contains, as a resin binder, a polycarbonate resin having structural units represented by General Formulae (1) and (2) below.

(General Formula (1))

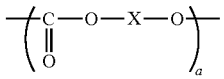

(1)

(General Formula (2))

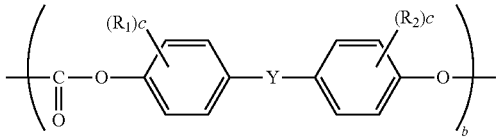

(2)

In General Formula (1), X is General Formula (3) or (4) below, and the polycarbonate resin may contain both units in which X is General Formula (3) below and units in which X is General Formula (4) below as structural units represented by General Formula (1). In General Formula (2), $R_1$ and $R_2$ may be the same or different, and are hydrogen atoms, $C_{1-12}$ alkyl groups, halogen atoms, $C_{6-12}$ optionally substituted aryl groups or $C_{1-12}$ alkoxy groups; c is an integer from 0 to 4; Y is a single bond, —O—, —S—, —SO—, —CO—, —$SO_2$—, or —$CR_3R_4$— (in which $R_3$ and $R_4$ may be the same or different, and are hydrogen atoms, $c_{1-12}$ alkyl groups, halogenated alkyl groups or $C_{6-12}$ optionally substituted aryl groups), or a bivalent group including a $C_{5-12}$ optionally substituted cycloalkylidene group, $C_{2-12}$ optionally substituted α,ω-alkylene group, -9,9-fluorenylidene group, $C_{6-12}$ optionally substituted arylene group or $C_{6-12}$ aryl group or arylene group; and a and b are the respective molar percentages of structural units (1) and (2) relative to the total number of moles of structural units (1) and (2).

(General Formula (3))

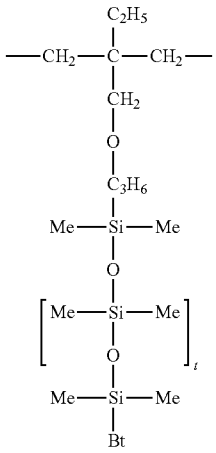

(3)

-continued (General Formula (4))

(4)

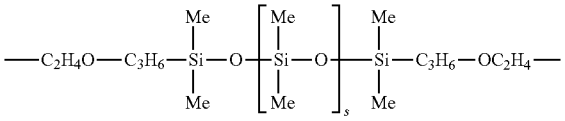

In General Formulae (3) and (4), t and s are each an integer of 1 or greater.

In the photoreceptor of the present invention, a in General Formula (1) above is preferably 0.001 to 10 mol %. It is also desirable for $R_1$ and $R_2$ in General Formula (2) above to each independently be hydrogen atom or methyl group, while Y is —$CR_3R_4$— and $R_3$ and $R_4$ are each independently a hydrogen atom or methyl group. It is also desirable in General Formula (2) above for $R_1$ and $R_2$ to each independently be a hydrogen atom or methyl group, while Y is —$CR_3R_4$— and $R_3$ and $R_4$ are a methyl group and an ethyl group, respectively. It is also desirable in General Formula (2) above for $R_1$ and $R_2$ to each independently be a hydrogen atom or methyl group, while Y is a cyclohexylidene group, single bond, or -9,9-fluorenylidene group.

In the present invention, the outermost layer of the photosensitive layer, or in other words the outer layer of the stack in the case of a stack or the monolayer photosensitive layer in the case of a monolayer, contains the aforementioned polycarbonate resin as a resin binder, and provides the desired effects of the present invention. Preferably, in the photoreceptor of the present invention, the photosensitive layer is a stacked layer having at least a charge generating layer and a charge transport layer, and the charge transport layer contains the aforementioned polycarbonate resin and a charge transport material. In this case, the charge generating layer and charge transport layer are preferably stacked in that order on the conductive substrate. Also, in the photoreceptor of the present invention the photosensitive layer can preferably be a monolayer that contains the aforementioned polycarbonate resin, a charge generating material and a charge transport material. In this case, the charge transport material preferably comprises a hole transport material and an electron transport material. Moreover, in the photoreceptor of the present invention the photosensitive layer can preferably be a stacked layer having at least a charge transport layer and a charge generating layer, with the charge generating layer containing the aforementioned polycarbonate resin, a charge generating material and a charge transport material. In this case, the charge transport layer need not contain the aforementioned polycarbonate resin. Also, in this case the charge transport layer and charge generating layer are preferably stacked on the conductive substrate in that order, and the charge transport layer preferably contains a hole transport material and an electron transport material.

The electrophotographic photoreceptor manufacturing method of the present invention is an electrophotographic photoreceptor manufacturing method comprising a step of applying a coating liquid containing at least a resin binder to a conductive substrate to thereby form a photosensitive layer, wherein the coating liquid contains as a resin binder a polycarbonate resin having structural units represented by General Formulae (1) and (2) above.

The electrophotographic device of the present invention has the electrophotographic receptor of the present invention installed therein.

With the present invention, it is possible to maintain a low friction coefficient on the surface of a photosensitive layer from the beginning until after printing while maintaining the electrophotographic characteristics of the photoreceptor by using a polycarbonate resin having the aforementioned specific structural units as a resin binder of the photosensitive layer. With the present invention it is also possible to achieve an electrophotographic photoreceptor that has improved cleaning properties and provides good images. Moreover, the polycarbonate resin of the present invention has been shown to have excellent solvent cracking resistance.

The polycarbonate resin of Japanese Patent Application Laid-open No. H5-113670 uses a siloxane-containing bivalent phenol, and therefore has a structure comprising a phenyl group sandwiched between a carbonate structure and a siloxane structure. Such a resin structure increases the resin rigidity excessively, lowering resistance to cracks due to internal stress during film formation. By contrast, in the polycarbonate resin of the present invention alcoholic hydroxyl (hydroxyalkyl) structures are included at one or both termini of the siloxane sites, forming carbonate bonds and introducing siloxane structures into the resin. Moreover, in the polycarbonate resin of the present invention the siloxane structures and hydroxyalkyl groups are bound via ether bonds. Thus, the polycarbonate resin of the present invention has a structure comprising ethylene parts and ether bonds, and it is expected that this will make it easier to mitigate internal stress. With prior art, there are no examples of binder resins using polycarbonate resins with siloxane structures incorporated by means of hydroxyalkyl structures.

Moreover, in the present invention the structure represented by General Formula (3) above is a structure containing a single-terminal siloxane component, with terminal butyl groups. Thus, the effect of controlling compatibility of the resin with the charge transport material is obtained by using a resin containing this structure. Moreover, because the siloxane component in the structure represented by Structural Formula (3) above is arranged in a comb shape relative to the main chain of the resin, the effect of a branching structure is obtained in contrast with the structure represented by Structural Formula (4), in which the siloxane structure is incorporated into the main chain, allowing for changes in the relationship between molecular weight and the viscosity of the coating liquid.

DETAILED DESCRIPTION OF THE INVENTION

Embodiments of the present invention are explained in detail below using drawings. The present invention is not in any way limited by the following explanations.

Figure 1A:
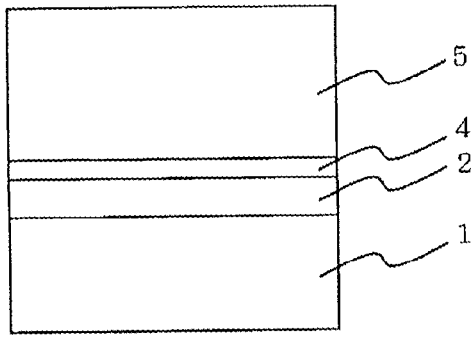
FIG. 1(*a*) is a model cross-section showing a negatively charged functionally separated stacked electrophotographic photoreceptor of the present invention, FIG. 1(*b*) is a model cross-section showing a positively charged monolayer electrophotographic photoreceptor of the present invention, and FIG. 1(*c*) is a model cross-section showing a positively charged stacked electrophotographic photoreceptor of the present invention.
Figure 1B:
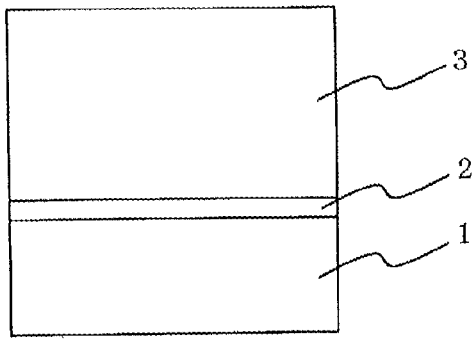
Figure 1C:
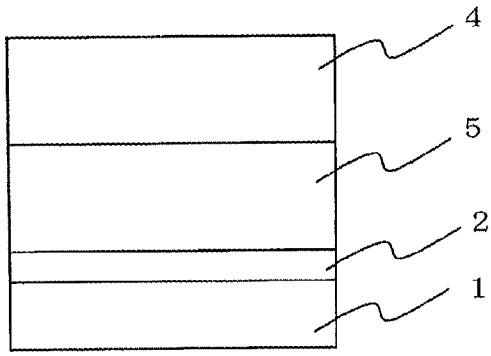

As discussed above, electrophotographic photoreceptors are broadly separated into stacked (functionally separated) photoreceptors including negatively-charged stacked photoreceptors and positively-charged stacked photoreceptors, and monolayer photoreceptors, which are generally positively charged. FIG. 1 is a model cross-section showing an electrophotographic photoreceptor of one example of the present invention, with FIG. 1(*a*) being a negatively charged stacked electrophotographic photoreceptor, FIG. 1(*b*) a positively charged monolayer electrophotographic photoreceptor, and FIG. 1(*c*) a positively charged stacked electrophotographic photoreceptor. As shown in the drawing, the negatively charged stacked photoreceptor comprises an under coat layer 2, a charge generating layer 4 with a charge generating function, and a charge transport layer 5 with a charge transport function stacked in that order on conductive substrate 1. The positively charged monolayer photoreceptor comprises an under coat layer 2 and a monolayer photosensitive layer 3 having both a charge generating and a charge transport function stacked in that order on the conductive substrate 1. The positively charged stacked photoreceptor comprises an under coat layer 2, a charge transport layer 5 with a charge transport function, and a charge generating layer 4 having both a charge generating and a charge transport function, stacked in that order on the conductive substrate 1. The under coat layer 2 can be provided as necessary in any type of photoreceptor. In the present invention, the concept of a "photosensitive layer" includes both stacked photosensitive layers comprising a stacked charge generating layer and charge transport layer, and monolayer photosensitive layers.

The conductive substrate 1 serves as an electrode for the photoreceptor, while also being a support for the layers making up the photoreceptor, and may be in any form such as a cylinder, plate or film. A metal such as aluminum, stainless steel or nickel, or a glass or resin material that has been conductively treated on the surface, can be used as the material of the conductive substrate 1.

The under coat layer 2 is a layer mainly made of resin, or an alumite or other metal oxide film. This under coat layer 2 is provided as necessary in order to control the charge injection properties from the conductive substrate 1 to the photosensitive layer, to cover up defects on the surface of the conductive substrate, or to improve adhesiveness between the photosensitive layer and the conductive substrate 1. Examples of resin materials that can be used for the under coat layer 2 include casein, polyvinyl alcohol, polyamide, melamine, cellulose and other insulating polymers, and polythiophene, polypyrrole, polyaniline and other conductive polymers. These polymers can be used individually, or mixed together as appropriate. Metal oxides such as titanium dioxide, zinc oxide and the like can also be included in these resins.

Negatively Charged Stacked Photoreceptor

In the negatively charged stacked photoreceptor, the charge generating layer 4 receives light and generates charge, and is formed by a method such as applying a coating liquid obtained by dispersing particles of a charge generating material in a resin binder. It is important that it have both a high charge generating efficiency and the ability to inject the generated charge into the charge transport layer 5, preferably with little field dependency and good injection even under low-field conditions. X-type metal-free phthalocyanine, τ-type metal-free phthalocyanine, α-type titanyl phthalocyanine, β-type titanyl phthalocyanine, Y-type titanyl phthalocyanine, γ-type titanyl phthalocyanine, amorphous titanyl phthalocyanine, ϵ-type copper phthalocyanine and other phthalocyanine compounds, azo pigments, anthanthrone pigments, thiapyrilium pigments, perylene pigments, perinone pigments, squarilium pigments, quinacridone pigments and the like can be used individually or combined appropriately as charge generating materials, and a substance suited to the wavelength range of the exposure light source used in image formation can be selected appropriately.

As long as the charge generating layer 4 has a charge generating function, its thickness can be determined by the absorption coefficient of the charge generating material, but normally it is 1 μm or less or preferably 0.5 μm or less in thickness. The charge generating layer 4 can be formed principally of the charge generating material, and a charge transport material and the like can also be added thereto. Polymers and copolymers of polycarbonate resin, polyester resin, polyamide resin, polyurethane resin, vinyl chloride resin, vinyl acetate resin, phenoxy resin, polyvinyl acetal resin, polyvinyl butyral resin, polystyrene resin, polysulfone resin, diallyl phthalate resin and methacrylate ester resin and the like can be combined appropriately as resin binders.

The charge transport layer 5 is formed principally of a charge transport material and a resin binder. In the present invention, a polycarbonate resin having structural units represented by General Formulae (1) and (2) above must be used as a resin binder of the charge transport layer 5 in the case of a negatively-charge stacked photoreceptor. The desired effects of the present invention are thereby obtained.

In the photoreceptor of the present invention, the copolymer polycarbonate resin may also have other structural units. The compounded proportion of the structural units represented by General Formulae (1) and (2) above is preferably 10 to 100 mol % or especially 50 to 100 mol % of the total copolymer polycarbonate resin.

In the photoreceptor of the present invention, the amount a of the structural units (1) (siloxane component) is preferably 0.001 to 10 mol % given 100 mol % as the total (a+b) of the structural units represented by General Formulae (1) and (2) above. If the amount of a is less than 0.001 mol %, it may not be possible to maintain the necessary friction coefficient. If the amount of a exceeds 10 mol %, on the other hand, the film hardness may not be sufficient, and sufficient compatibility with the solvent and functional materials may not be obtained in the coating liquid.

In General Formulae (3) and (4) above, t and s are preferably integers from 1 to 400, or more preferably integers from 8 to 250.

Moreover, in the photoreceptor of the present invention it is desirable for $R_1$ and $R_2$ in General Formula (2) above to each independently be a hydrogen atom or methyl group, while Y is —$CR_3R_4$—, and $R_3$ and $R_4$ are each independently a hydrogen atom or methyl group. It is also desirable in General Formula (2) above for $R_1$ and $R_2$ to each independently be a hydrogen atom or methyl group, while Y is —$CR_3R_4$— and $R_3$ and $R_4$ are a methyl group and an ethyl group, respectively. It is also desirable in General Formula (2) above for $R_1$ and $R_2$ to each independently be a hydrogen atom or methyl group, while Y is a cyclohexylidene group, single bond, or -9,9-fluorenylidene group. It is also desirable to use a polycarbonate resin that is a copolymer comprising any two or more of these preferred structural units represented by General Formula (2) above. More preferably, $R_1$ and $R_2$ in General Formula (2) above are identical in the present invention.

Examples of the siloxane structure represented by General Formula (1) above, which is included in the copolymer polycarbonate resin used in the present invention, include for example constituent monomers having the basic structure represented by Molecular Formula (1-1) as shown in Table 1 below (for example, reactive silicone Silaplane FM4411 (number-average molecular weight 1000), FM4421 (number-average molecular weight 5000) and FM4425 (number-average molecular weight 15000), manufactured by Chisso Corp.) and the basic structure represented by Molecular Formula (1-2) as shown in Table 2 below (for example, reactive silicone Silaplane FMDA11 (number-average molecular weight 1000), FMDA21 (number average molecular weight 5000) and FMDA26 (number-average molecular weight 15000), manufactured by Chisso Corp.) and the like.

TABLE 1

| Structural Formula No. | Basic structure | Average molecular wt. | Example |
|---|---|---|---|
| (1-1)-1 | 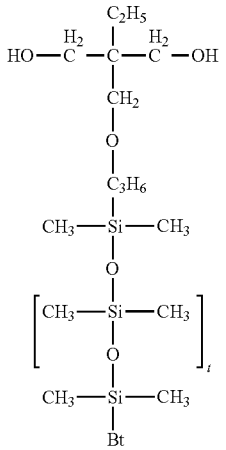 | 1000 | Chisso Corp. Silaplane FM-DA11 |
| (1-1)-2 | | 5000 | Chisso Corp. Silaplane FM-DA21 |
| (1-1)-3 | | 15000 | Chisso Corp. Silaplane FM-DA26 |

In the basic structure above, Bt represents an n-butyl group.

Specific examples of the structural units represented by General Formulae (1) and (2) above are given below. However, the copolymer polycarbonate resin of the present invention is not limited to these structural examples.

(1)-1

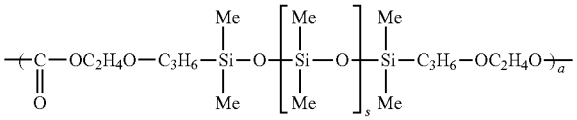

(1)-2

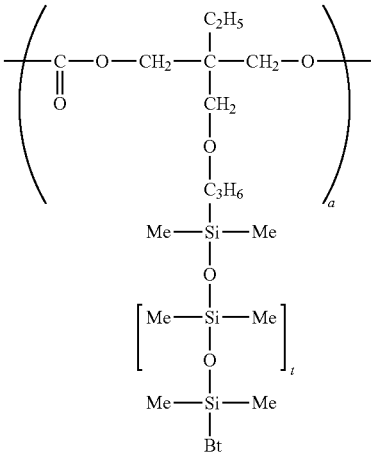

(2)-1

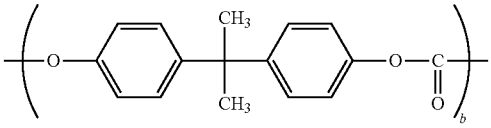

(2)-2

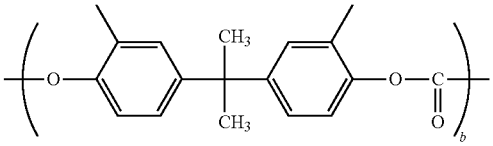

(2)-3

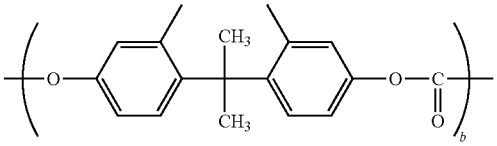

TABLE 2

| Structural Formula No. | Basic structure | Average molecular wt. | Example |
|---|---|---|---|
| (1-2)-1 | 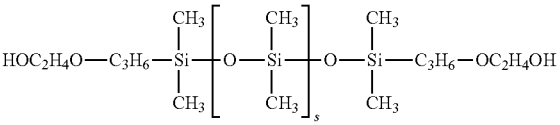 | 1000 | Chisso Corp. Silaplane FM-4411 |
| (1-2)-2 | | 5000 | Chisso Corp. Silaplane FM-4421 |
| (1-2)-3 | | 10000 | Chisso Corp. Silaplane FM-4425 |

-continued
(2)-4
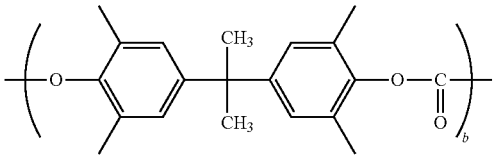
(2)-5
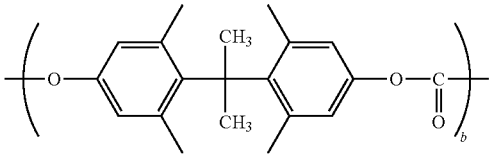
(2)-6
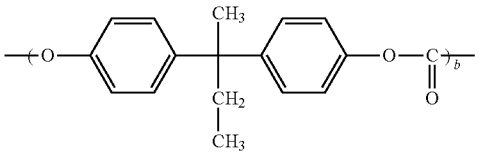
(2)-7
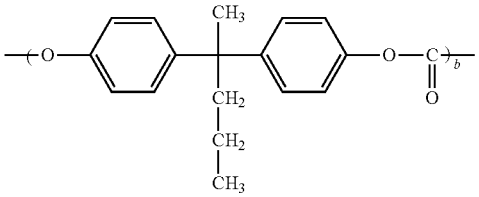
(2)-8
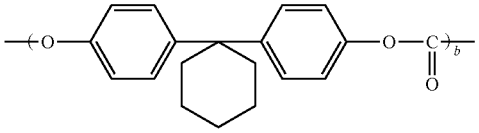
(2)-9
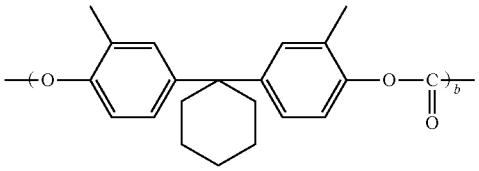
(2)-10
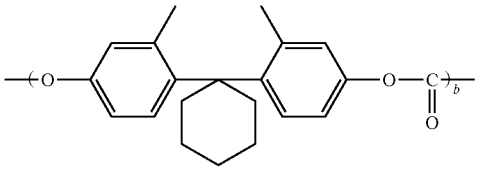
(2)-11
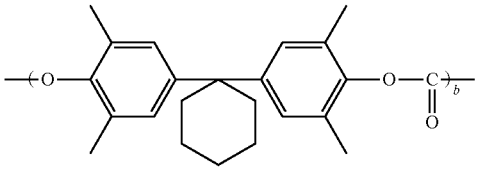
-continued
(2)-12
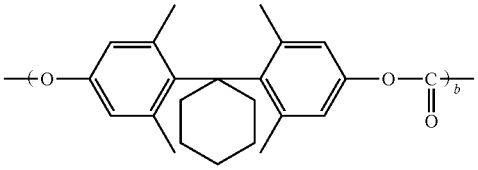
(2)-13
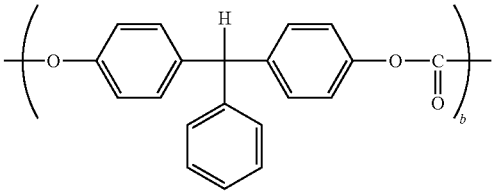
(2)-14
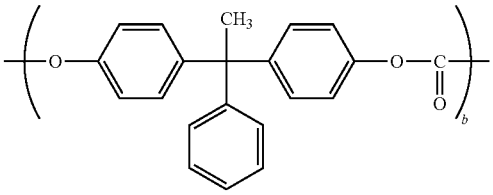
(2)-15
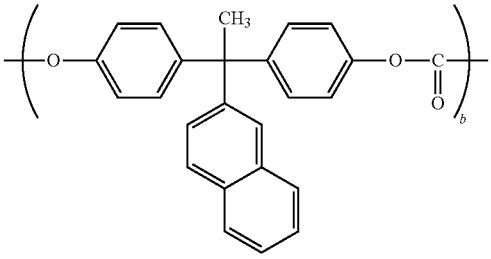
(2)-16
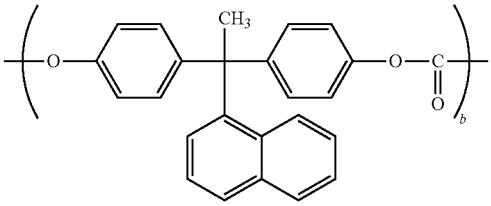
(2)-17
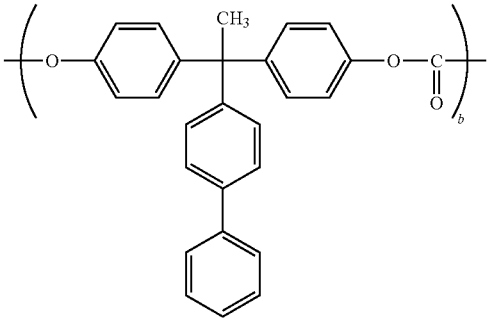

-continued
(2)-18
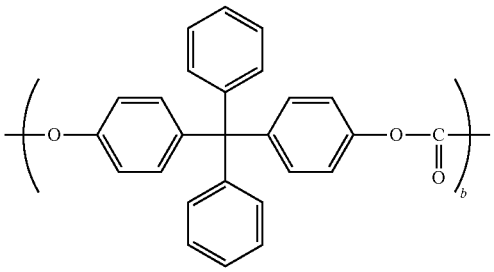
(2)-19
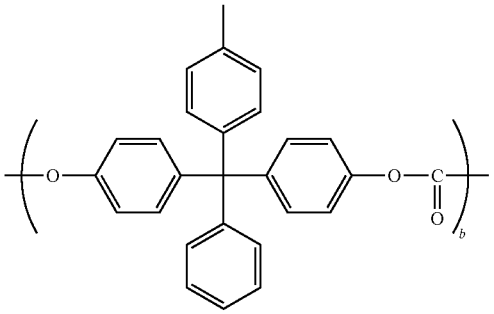
(2)-20
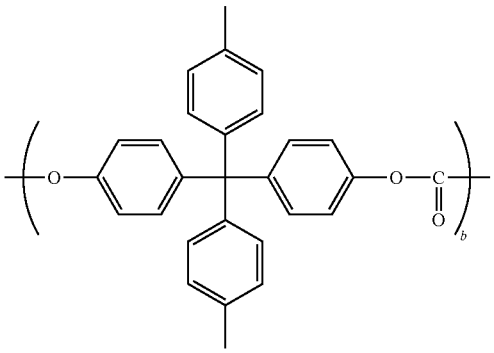
(2)-21
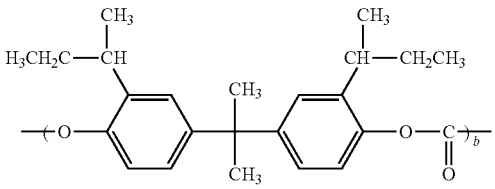
(2)-22
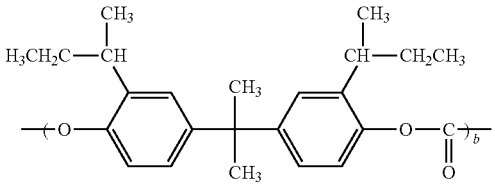
-continued
(2)-23
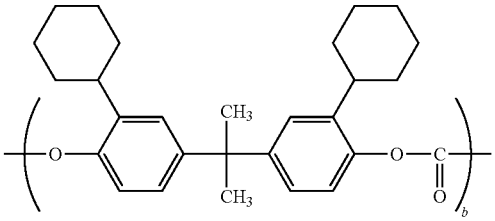
(2)-24
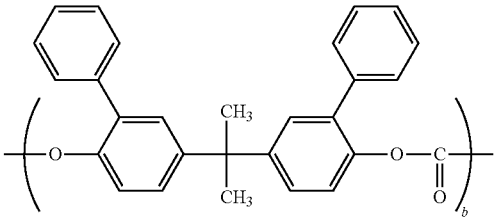
(2)-25
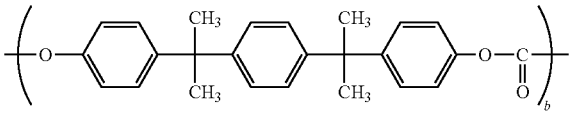
(2)-26
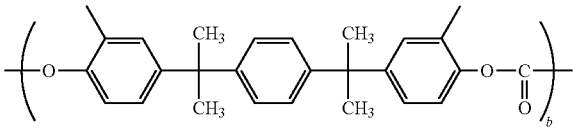
(2)-27
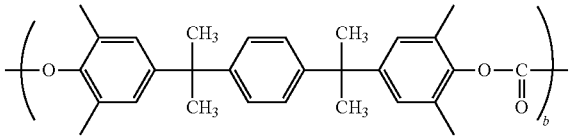
(2)-28
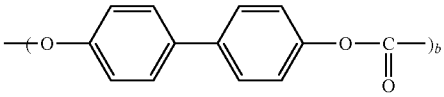
(2)-29
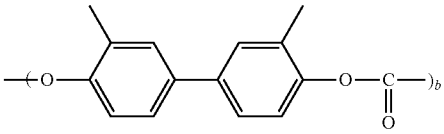
(2)-30
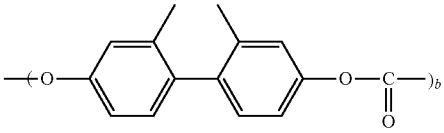
(2)-31
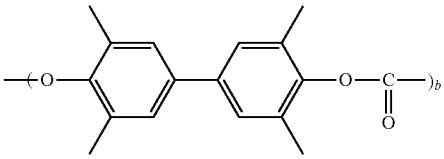

-continued
(2)-32
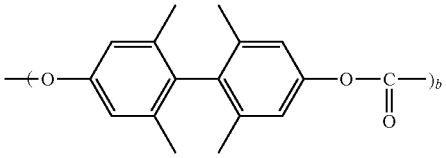
(2)-33
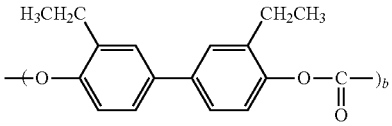
(2)-34
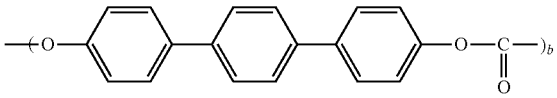
(2)-35
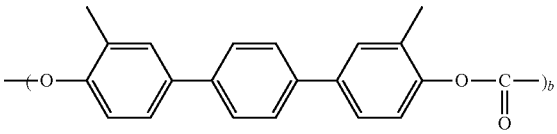
(2)-36
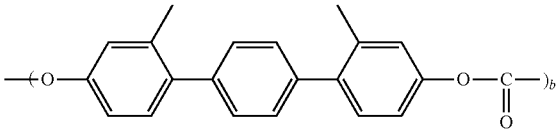
(2)-37
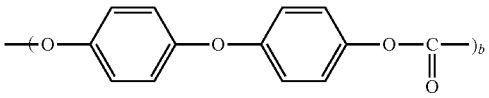
(2)-38
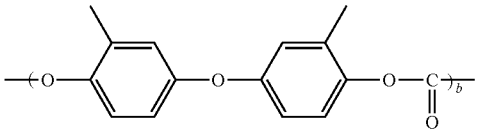
(2)-39
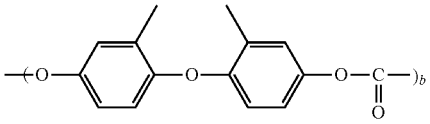
(2)-40
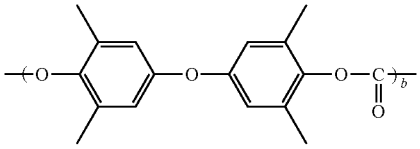
(2)-41
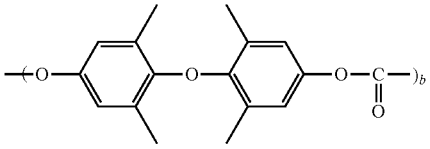
(2)-42
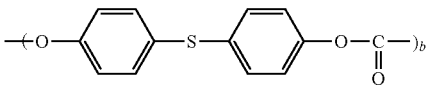
-continued
(2)-43
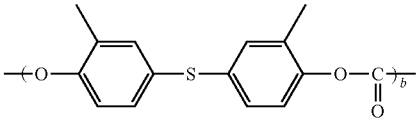
(2)-44
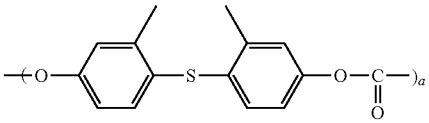
(2)-45
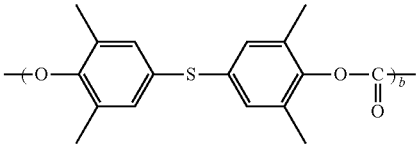
(2)-46
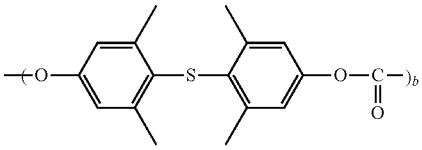
(2)-47
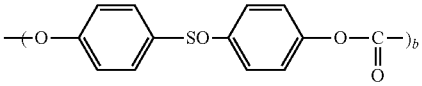
(2)-48
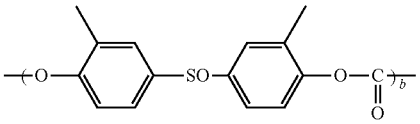
(2)-49
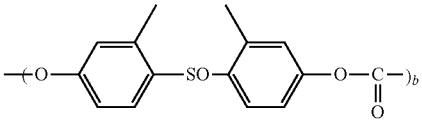
(2)-50
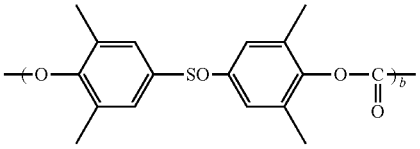
(2)-51
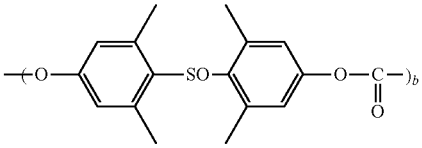
(2)-52
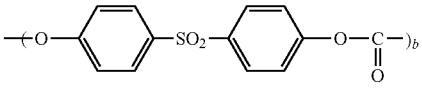
(2)-53
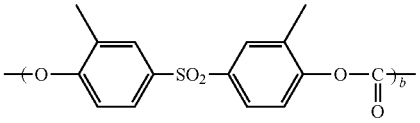

-continued
(2)-54
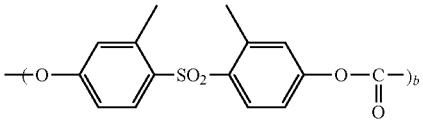
(2)-55
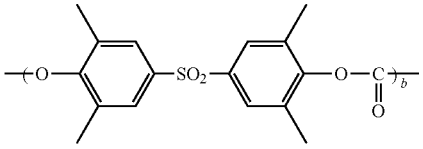
(2)-56
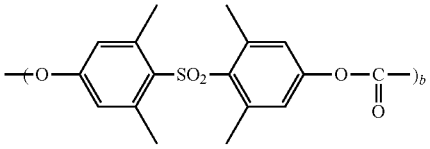
(2)-57
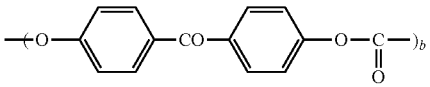
(2)-58
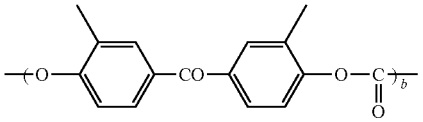
(2)-59
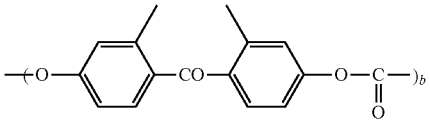
(2)-60
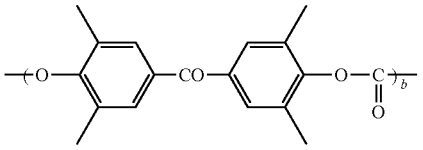
(2)-61
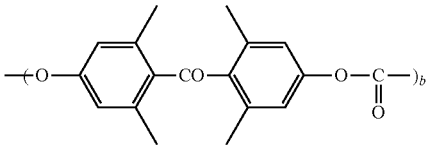
(2)-62
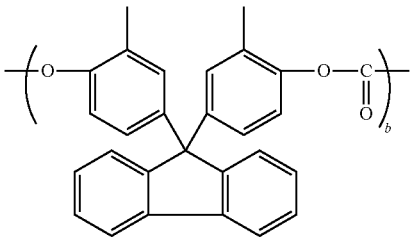
-continued
(2)-63
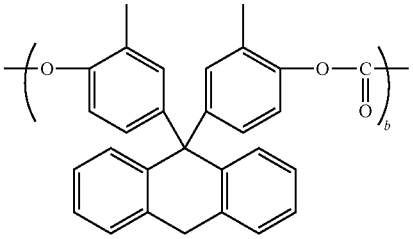
(2)-64
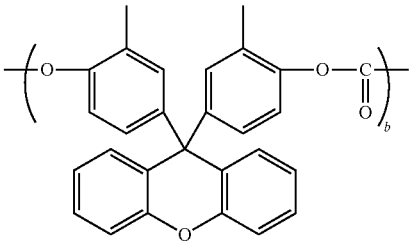
(2)-65
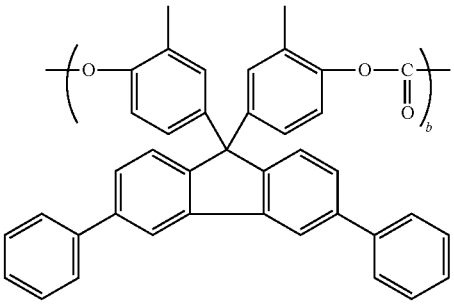
(2)-66
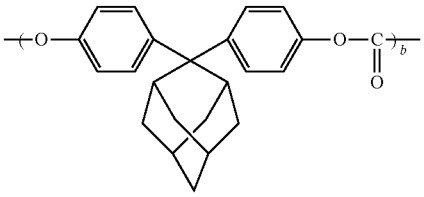
(2)-67
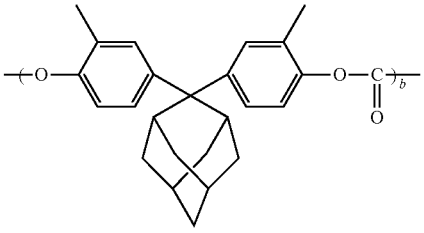
(2)-68
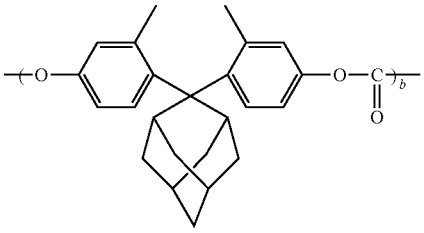

-continued
(2)-69
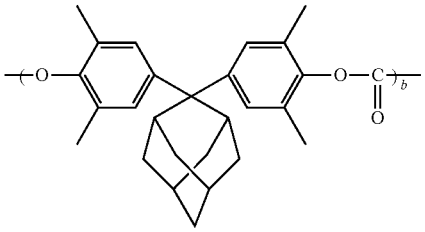
(2)-70
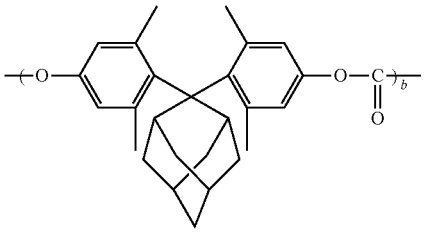
(2)-71
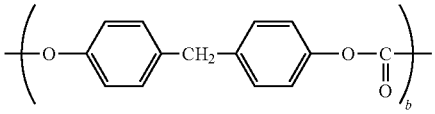
(2)-72
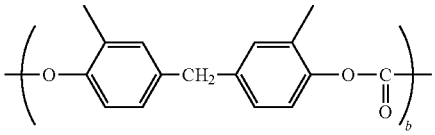
(2)-73
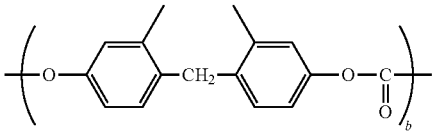
(2)-74
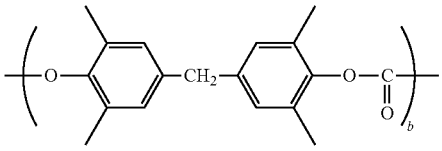
(2)-75
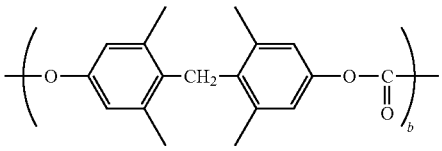
(2)-76
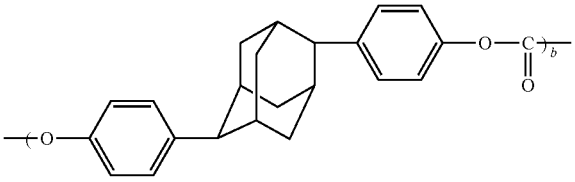
-continued
(2)-77
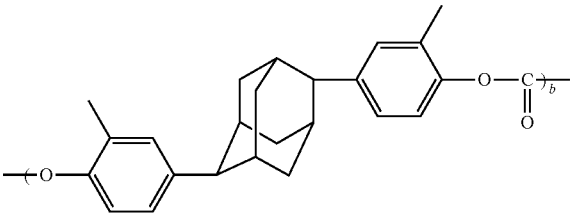
(2)-78
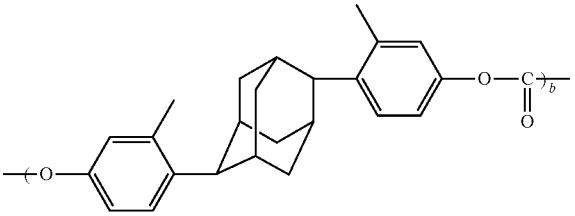
(2)-79
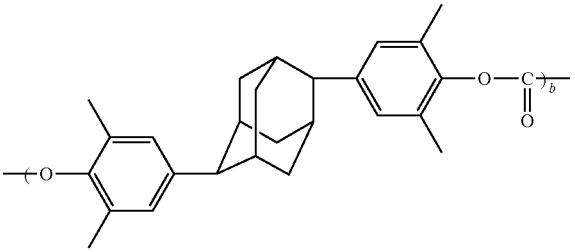
(2)-80
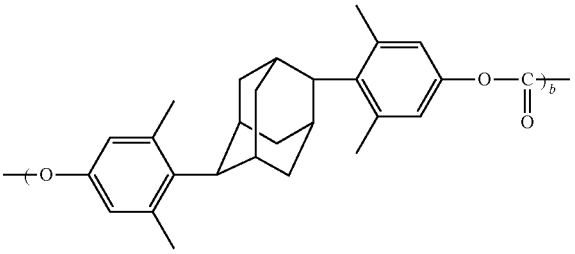
(2)-81
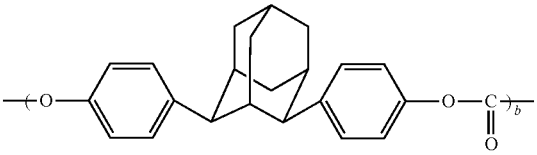
(2)-82
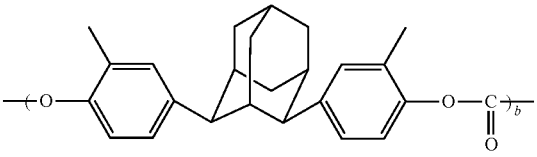

-continued (2)-83

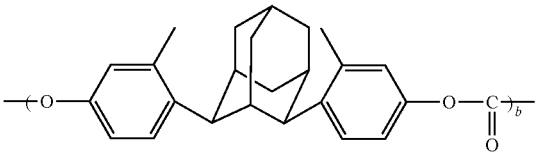

(2)-84

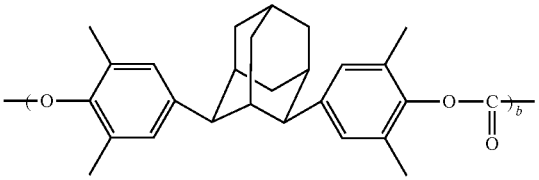

(2)-85

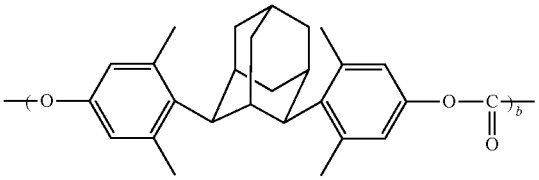

(2)-86

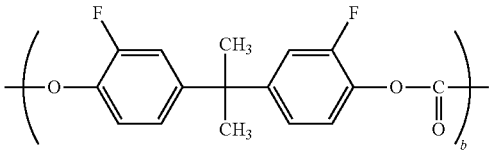

(2)-87

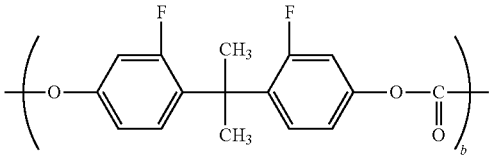

(2)-88

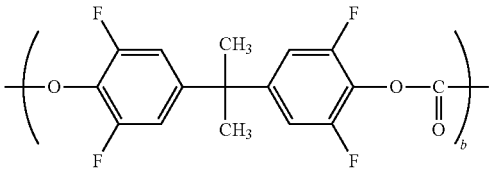

(2)-89

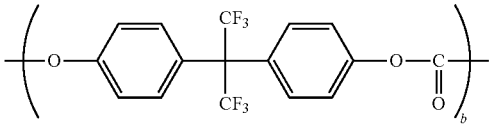

-continued (2)-90

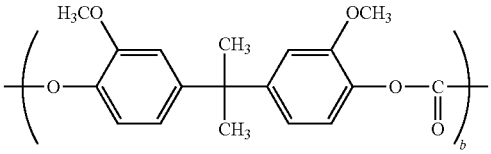

(2)-91

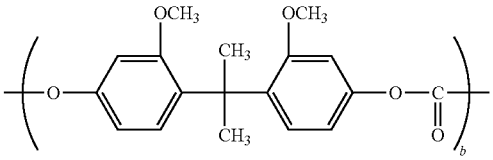

(2)-92

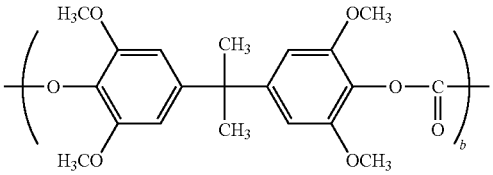

In the present invention, a copolymer polycarbonate resin having structural units represented by General Formula (1) and (2) above can be used alone, or may be combined with another resin. Bisphenol A, bisphenol Z, bisphenol A-biphenyl copolymer, bisphenol Z-biphenyl copolymer and various other polycarbonate resins, and polyallylate resin, polyphenylene resin, polyester resin, polyvinyl acetal resin, polyvinyl butyral resin, polyvinyl alcohol resin, vinyl chloride resin, vinyl acetate resin, polyethylene resin, polypropylene resin, acrylic resin, polyurethane resin, epoxy resin, melamine resin, silicone resin, polyamide resin, polystyrene resin, polyacetal resin, polysulfone resin and methacrylate ester polymers and copolymers of these can be used as this other resin. A mixture of resins of the same kind with different molecular weights can also be used.

The content of the resin binder in the charge transport layer 5 is preferably 10 to 90 mass % or more preferably 20 to 80 mass % of the solids in the charge transport layer 5. The content of the copolymer polycarbonate resin of the present invention relative to this resin binder is preferably 1 to 100 mass % or more preferably 5 to 100 mass % or still more preferably 5 to 80 mass %.

The weight-average molecular weight of the polycarbonate resin of the present invention is preferably 5000 to 250,000, or more preferably 10,000 to 150,000.

Various hydrazone compounds, styryl compounds, diamine compounds, butadiene compounds, indole compounds and the like can be used individually or mixed in appropriate combinations as the charge transport material of the charge transport layer 5. Examples of this charge transport material include, but are not limited to, those represented by (II-1) to (II-14) below.

II-1
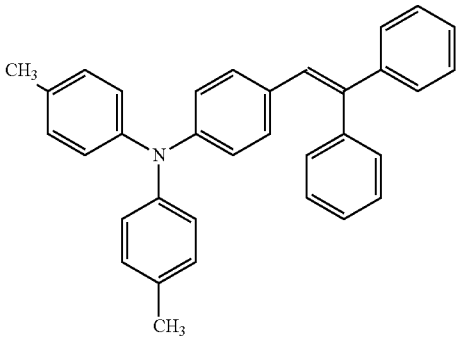
II-2
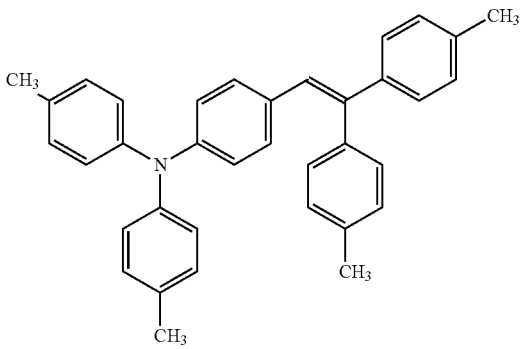
II-3
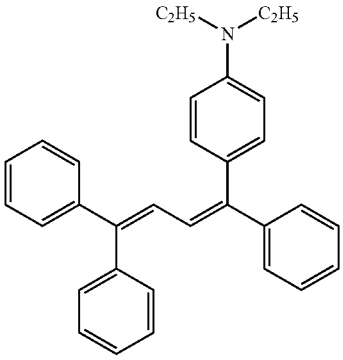
II-4
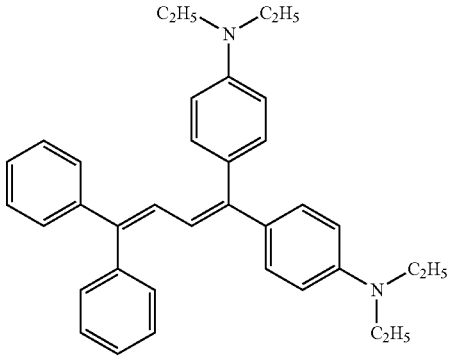
II-5
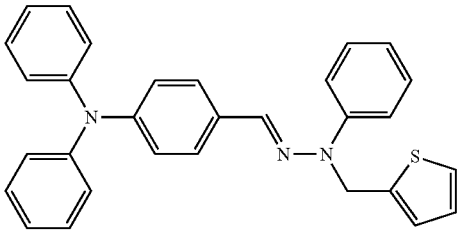
II-6
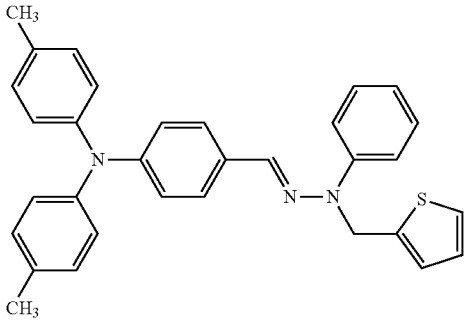
II-7
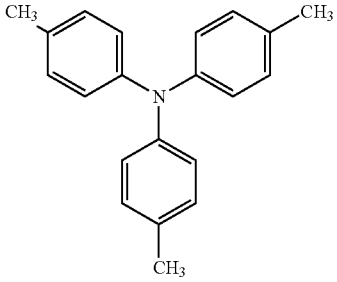

-continued
II-8
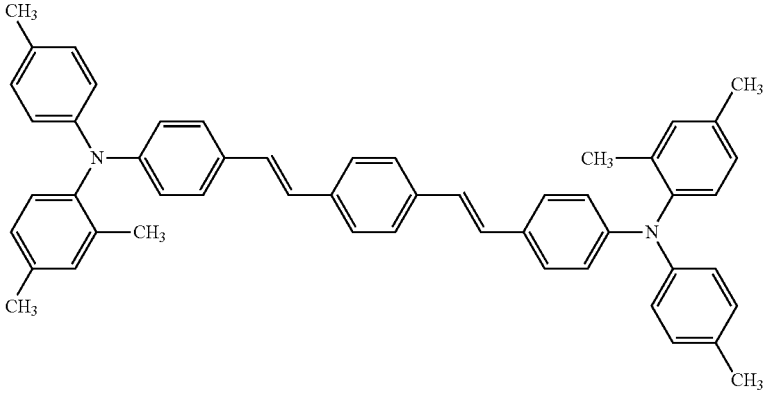
II-9
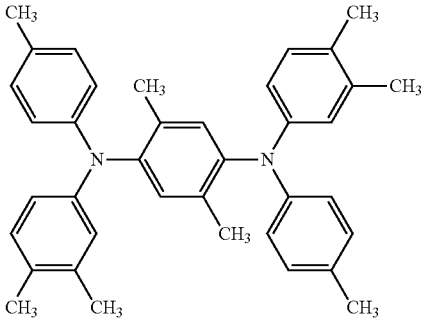
II-10
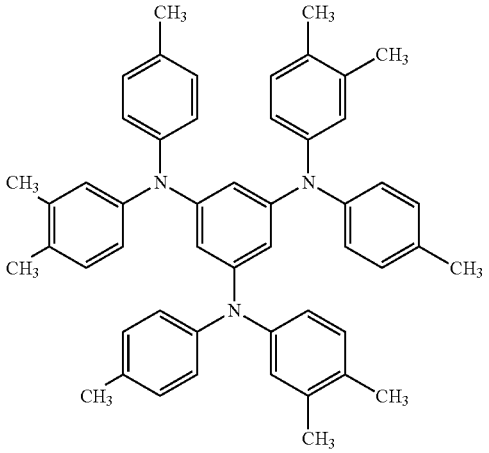
II-11
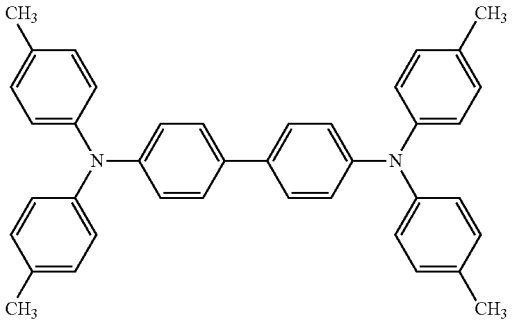
II-12
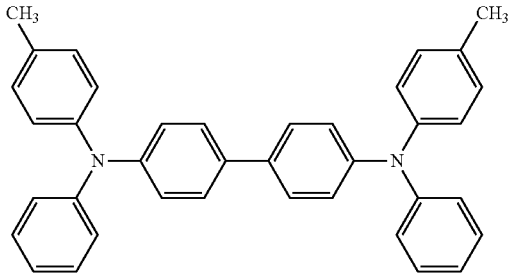
II-13
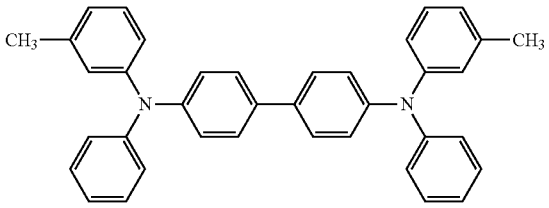
II-14
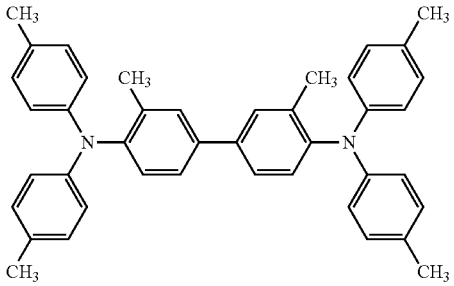

The film thickness of the charge transport layer 5 is preferably in the range of 3 to 50 μm or more preferably in the range of 15 to 40 μm so as to maintain an effective surface potential for actual use.

Monolayer Photoreceptor

In the case of a monolayer photoreceptor, the photosensitive layer 3 is formed principally of a charge generating material, a hole transport material, an electron transport material (acceptor compound) and a resin binder in the present invention. In the present invention, it is necessary to use a polycarbonate resin having structural units represented by General Formulae (1) and (2) as a resin binder of the photosensitive layer 3 in a monolayer photoreceptor.

A phthalocyanine pigment, azo pigment, anthanthrone pigment, perylene pigment, perinone pigment, polycyclic quinone pigment, squarylium pigment, thiapyrilium pigment, quinacridone pigment or the like for example can be used as the charge generating material in this case. These charge generating materials may be used independently, or two or more may be used in combination. In the electrophotographic photoreceptor of the present invention, disazo pigments and trisazo pigments are particularly desirable as azo pigments, N,N'-bis(3,5-dimethylphenyl)-3,4:9,10-perylene-bis(carboxylmide) as a perylene pigment, and metal-free phthalocyanine, copper phthalocyanine and titanyl phthalocyanine as phthalocyanine pigments. Moreover, notable improvements in sensitivity, durability and image quality are obtained by using X-type metal-free phthalocyanine, τ-type metal-free phthalocyanine, ϵ-type copper phthalocyanine, α-type titanyl phthalocyanine, β-type titanyl phthalocyanine, Y-type titanyl phthalocyanine, amorphous titanyl phthalocyanine, and the titanyl phthalocyanine described in Japanese Patent Application Laid-open No. H8-209023, U.S. Pat. No. 5,736,282 and U.S. Pat. No. 5,874,570, which has a maximum peak at a Bragg angle 2θ of 9.6° in the CuKα: X-ray diffraction spectrum. The content of the charge generating material is preferably 0.1 to 20 mass % or more preferably 0.5 to 10 mass % of the solids in the monolayer photosensitive layer 3.

A hydrazone compound, pyrazoline compound, pyrazolone compound, oxadiazole compound, oxazole compound, arylamine compound, benzidine compound, stilbene compound or styryl compound or poly-N-vinyl carbazole, polysilane or the like for example can be used as the hole transport material. One of these hole transport materials may be used alone, or two or more may be used in combination. The hole transport material used in the present invention is preferably one that has excellent ability to transport the holes generated during light exposure, and is suitable for combining with the charge generating material. The content of the hole transport material is preferably 3 to 80 mass %, or more preferably 5 to 60 mass % of the solids in the monolayer photosensitive layer 3.

Succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranyl, bromanyl, o-nitrobenzoic acid, malononitrile, trinitrofluorenone, trinitrothioxanthone, dinitrobenzene, dinitroanthracene, dinitroacridine, nitroanthraquinone, dinitrothanthraquinone, thiopyran compounds, quinone compounds, benzoquinone compounds, diphenoquinone compounds, naphthoquinone compounds, anthraquinone compounds, stilbenequinone compounds, azoquinone compounds and the like can be used as the electron transport material (acceptor compound). These electron transport materials may be used independently, or two or more may be used in combination. The content of the electron transport material is preferably 1 to 50 mass % or more preferably 5 to 40 mass % of the solids of the monolayer photosensitive layer 3.

In the present invention, as discussed above, it is necessary to use a polycarbonate resin containing the structural units represented by General Formulae (1) and (2) above as a resin binder of the monolayer photosensitive layer 3. It is thus possible to obtain the desired effects of the present invention. Examples of the copolymer polycarbonate resin include those listed above.

A polycarbonate resin having the structural units represented by General Formulae (1) and (2) above may be used independently as the resin binder of the monolayer photosensitive layer 3, or may be mixed with another resin. Bisphenol A, bisphenol Z, bisphenol A-biphenyl copolymer, bisphenol Z-biphenyl copolymer and various other polycarbonate resins, and polyphenylene resin, polyester resin, polyvinyl acetal resin, polyvinyl butyral resin, polyvinyl alcohol resin, vinyl chloride resin, vinyl acetate resin, polyethylene resin, polypropylene resin, acrylic resin, polyurethane resin, epoxy resin, melamine resin, silicone resin, polyamide resin, polystyrene resin, polyacetal resin, polyallylate resin, polysulfone resin and methacrylate ester polymers and copolymers of these can be used as this other resin. A mixture of resins of the same kind with different molecular weights can also be used.

The content of the resin binder is preferably 10 to 90 mass % or more preferably 20 to 80 mass % of the solids in the monolayer photosensitive layer 3. The content of the copolymer polycarbonate resin in this resin binder is preferably 1 mass % to 100 mass % or more preferably 5 mass % to 80 mass %.

The thickness of the monolayer photosensitive layer 3 is in the range of preferably 3 to 100 μm or more preferably 5 to 40 μm in order to maintain an effective surface potential for practical use.

Positively-Charged Stacked Photoreceptor

In the positively charged stacked photoreceptor, the charge transport layer 5 is formed principally of a charge transport material and a resin binder. The same materials given as examples above for the charge transport layer 5 of the negatively-charged stacked photoreceptor can be used for the charge transport material and resin binder, without any particular limitations. The content of each material and the thickness of the charge transport layer 5 may also be similar to those in the negatively charged stacked photoreceptor. In the case of a positively charged stacked photoreceptor, however, it is not essential to use a polycarbonate resin having the structural units represented by General Formulae (1) and (2) above as a resin binder in charge transport layer 5, and any can be used.

The charge generating layer 4 on the charge transport layer 5 is formed principally of a charge generating material, a hole transport material, an electron transport material (acceptor compound) and a resin binder. The same materials given as examples above for the monolayer photosensitive layer 3 of the monolayer photoreceptor can be used as the charge generating material, hole transport material, electron transport material and resin binder, without any particular limitations. The content of each material and the thickness of the charge generating layer 4 may also be similar to those in the monolayer photosensitive layer 3 of the monolayer photoreceptor. In the positively charged stacked photoreceptor, a polycarbonate resin having structural units represented by General Formulae (1) and (2) above must be used as a resin binder of charge generating layer 4. The desired effects of the present invention are obtained thereby. Examples of this copolymer polycarbonate resin include those given above.

In the present invention, anti-oxidants, light stabilizers and other deterioration prevention agents can be included in either a stacked or monolayer photosensitive layer in order to improve environmental resistance and stability with respect to harmful light. Examples of compounds that can be used for such purposes include tocopherol and other chromanol derivatives and esterified compounds, polyaryl alkane compounds, hydroquinone derivatives, etherified compounds, dietherified compounds, benzophenone derivatives, benzotriazole derivatives, thioether compounds, phenylenediamine derivatives, phosphonic acid esters, phosphorous acid esters, phenol compounds, hindered phenol compounds, linear amine compounds, cyclic amine compounds, hindered amine compounds and the like.

A leveling agent such as silicone oil or fluorine oil can also be included in the photosensitive layer in order to confer lubricity and improve the leveling properties of the formed film. Fine particles of silicon oxide (silica), titanium oxide, zinc oxide, calcium oxide, aluminum oxide (alumina), zirconium oxide and other metal oxides, barium sulfate, calcium sulfate and other metal sulfates, and silicon nitride, aluminum nitride and other metal nitrides, or ethylene tetrafluoride resin and other fluorine resin particles and fluorine comb-shaped graft polymer resins and the like can also be included with the aim of adjusting the film hardness, reducing the friction coefficient and conferring lubricity and the like. Other known additives can also be included as necessary to the extent that they do not detract significantly from the electrophotographic properties.

Electrophotographic Device

The desired effects are obtained by applying the electrophotographic photoreceptor to various machine processes. Specifically, satisfactory effects can be obtained in contact charging systems using rollers, brushes and the like, non-contact charging systems using corotrons, scorotrons and the like and other charging processes, and in non-contact development and contact development using non-magnetic single component, magnetic single component, two-component and other developing systems.

Figure 2:
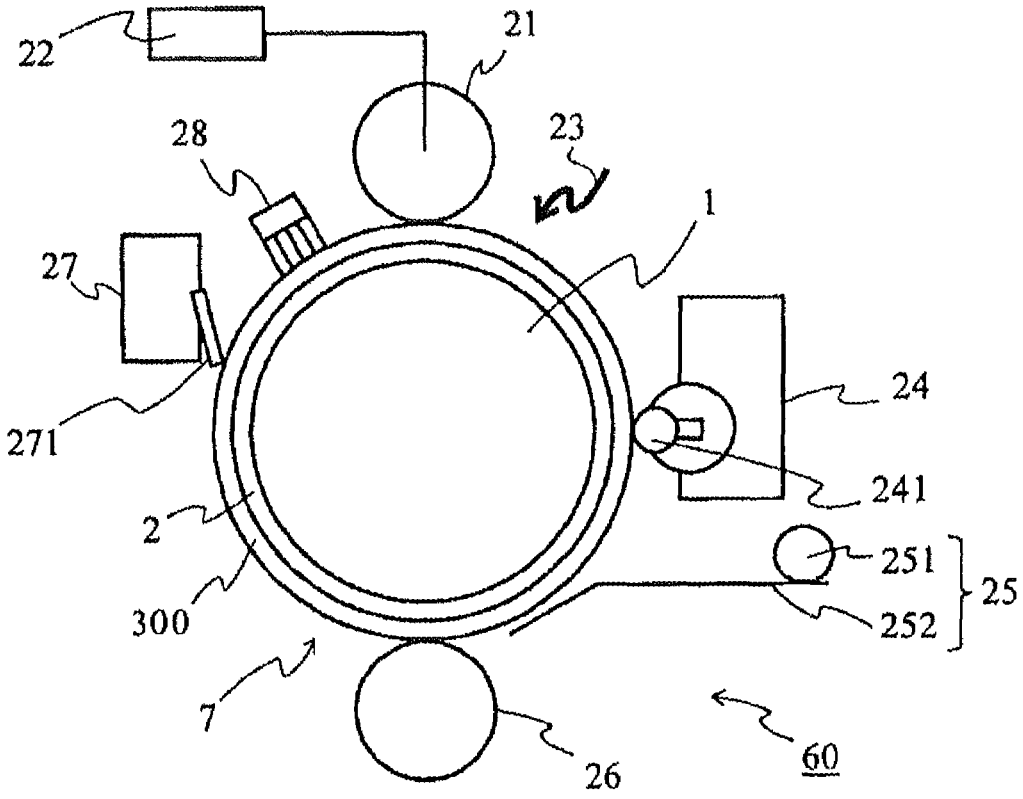
FIG. 2 is a structural diagram showing an electrophotographic device of the present invention.

As one example, FIG. 2 is a structural diagram showing an electrophotographic device of the present invention. Electrophotographic device 60 of the present invention is equipped with electrophotographic photoreceptor 7 comprising conductive substrate 1 covered on the outer circumference by under coat layer 2 and photosensitive layer 300. This electrophotographic device 60 also comprises roller charging member 21 on the outer periphery of photoreceptor 7, high-voltage power supply 22 supplying applied voltage to roller charging member 21, image exposure member 23, developer 24 equipped with developing roller 241, paper feed member 25 provided with paper feed roller 251 and paper feed guide 252, transfer charger (direct charging type) 26, cleaning mechanism 27 equipped with cleaning blade 271, and neutralization apparatus 28. Electrophotographic device 60 of the present invention may be a color printer.

EXAMPLES

Specific embodiments of the present invention are explained in more detail below using examples. The present invention is not limited to the following examples as long as its gist is not exceeded.

Manufacture of Copolymer Polycarbonate Resin

Manufacturing Example 1

Method of Manufacturing Copolymer Polycarbonate Resin (III-1)

45.20 g of the bisphenol A represented by Molecular Formula (4)-1 in Table 3 below and 2.00 g of the compound represented by Molecular Formula (1-2)-1 above (Silaplane™ FM-4411, Chisso Corp.) were dissolved in 180 ml of 10% NaOH aqueous solution in a 2-liter 4-neck flask, and mixed with 120 g of methylene chloride. With the liquid temperature maintained at 15 to 20° C., 19.3 g of phosgene gas was blown in over the course of 30 minutes with agitation. After the blowing, 5 g of methylene chloride having dissolved therein 0.60 g of p-t-butylphenol was added, and 27 ml of 10% NaOH aqueous solution was added to promote the reaction. After this, 0.74 g of triethylamine was added, the mixture was agitated for a further 1 hour, and the reaction was completed.

After completion of the reaction, this was diluted by addition of 120 g of methylene chloride, the water phase was separated, 200 ml of ion-exchange water was added and agitated to perform water washing. This was then water washed with 200 ml of 0.1 N sodium hydroxide solution and 200 ml of 0.01 N hydrochloric acid, and water washed several times with ion-exchange water, continuing until the conductivity of the water layer was 2 μs/m or less. The methylene chloride phase was then dripped into four times the volume of methanol under agitation, and the resulting re-precipitate was filtered out and dried to obtain 21 g of the target copolymer polycarbonate resin (III-1). When the weight-average molecular weight (as polystyrene) of this (III-1) resin was measured by GPC (gel permeation chromatography), the molecular weight was 105,000. The copolymerization ratio a:b was 1:99 as a molar ratio (shown in Table 4 below).

Manufacturing Example 2

Method of Manufacturing Copolymer Polycarbonate Resin (III-2)

Synthesis was performed as in Manufacturing Example 1 except that the amount of bisphenol A in Manufacturing Example 1 was changed to 44.74 g, and the amount of the compound represented by Molecular Formula (1-2)-1 was changed to 4.00 g. The copolymerization ratio conditions of the resulting copolymer polycarbonate resin (III-2) are shown in Table 4 below.

Manufacturing Example 3

Method of Manufacturing Copolymer Polycarbonate Resin (III-3)

Synthesis was performed as in Manufacturing Example 1 except that the amount of bisphenol A in Manufacturing Example 1 was changed to 41.09 g, and the amount of the compound represented by Molecular Formula (1-2)-1 was changed to 20.00 g. The copolymerization ratio conditions of the resulting copolymer polycarbonate resin (III-3) are shown in Table 4 below.

Manufacturing Example 4

Method of Manufacturing Copolymer Polycarbonate Resin (III-4)

Synthesis was performed as in Manufacturing Example 1 except that the amount of bisphenol A in Manufacturing Example 1 was changed to 45.61 g, and the amount of the compound represented by Molecular Formula (1-2)-1 was changed to 0.20 g. The copolymerization ratio conditions of the resulting copolymer polycarbonate resin (III-4) are shown in Table 4 below.

Manufacturing Example 5

Method of Manufacturing Copolymer Polycarbonate Resin (III-5)

Synthesis was performed as in Manufacturing Example 1 except that the amount of bisphenol A in Manufacturing Example 1 was changed to 46.65 g, and the amount of the compound represented by Molecular Formula (1-2)-1 was changed to 0.02 g. The copolymerization ratio conditions of the resulting copolymer polycarbonate resin (III-5) are shown in Table 4 below.

Manufacturing Example 6

Method of Manufacturing Copolymer Polycarbonate Resin (III-6)

Synthesis was performed as in Manufacturing Example 1 except that the compound represented by Molecular Formula (1-2)-1 in Manufacturing Example 1 was replaced with the compound represented by Molecular Formula (1-2)-2, in the amount of 10.00 g. The copolymerization ratio conditions of the resulting copolymer polycarbonate resin (III-6) are shown in Table 4 below.

Manufacturing Example 7

Method of Manufacturing Copolymer Polycarbonate Resin (III-7)

Synthesis was performed as in Manufacturing Example 6 except that the amount of the bisphenol A in Manufacturing Example 6 was changed to 44.75 g, and the amount of the compound represented by Molecular Formula (1-2)-2 was changed to 20.00 g. The copolymerization ratio conditions of the resulting copolymer polycarbonate resin (III-7) are shown in Table 4 below.

Manufacturing Example 8

Method of Manufacturing Copolymer Polycarbonate Resin (III-8)

Synthesis was performed as in Manufacturing Example 6 except that the amount of the bisphenol A in Manufacturing Example 6 was changed to 45.61 g, and the amount of the compound represented by Molecular Formula (1-2)-2 was changed to 1.00 g. The copolymerization ratio conditions of the resulting copolymer polycarbonate resin (III-8) are shown in Table 4 below.

Manufacturing Example 9

Method of Manufacturing Copolymer Polycarbonate Resin (III-9)

Synthesis was performed as in Manufacturing Example 6 except that the amount of the bisphenol A in Manufacturing Example 6 was changed to 45.65 g, and the amount of the compound represented by Molecular Formula (1-2)-2 was changed to 0.1 g. The copolymerization ratio conditions of the resulting copolymer polycarbonate resin (III-9) are shown in Table 4 below.

Manufacturing Example 10

Method of Manufacturing Copolymer Polycarbonate Resin (III-10)

Synthesis was performed as in Manufacturing Example 1 except that the compound represented by Molecular Formula (1-2)-1 in Manufacturing Example 1 was replaced with the compound represented by Molecular Formula (1-2)-3, in the amount of 20.00 g. The copolymerization ratio conditions of the resulting copolymer polycarbonate resin (III-10) are shown in Table 4 below.

Manufacturing Example 11

Method of Manufacturing Copolymer Polycarbonate Resin (III-11)

Synthesis was performed as in Manufacturing Example 10 except that the amount of the bisphenol A in Manufacturing Example 10 was changed to 44.75 g, and the amount of the compound represented by Molecular Formula (1-2)-3 was changed to 40.00 g. The copolymerization ratio conditions of the resulting copolymer polycarbonate resin (III-11) are shown in Table 4 below.

Manufacturing Example 12

Method of Manufacturing Copolymer Polycarbonate Resin (III-12)

Synthesis was performed as in Manufacturing Example 10 except that the amount of the bisphenol A in Manufacturing Example 10 was changed to 45.65 g, and the amount of the compound represented by Molecular Formula (1-2)-3 was changed to 0.20 g. The copolymerization ratio conditions of the resulting copolymer polycarbonate resin (III-12) are shown in Table 4 below.

Manufacturing Example 13

Method of Manufacturing Copolymer Polycarbonate Resin (III-13)

Synthesis was performed as in Manufacturing Example 10 except that the amount of the bisphenol A in Manufacturing Example 10 was changed to 45.61 g, and the amount of the compound represented by Molecular Formula (1-2)-3 was changed to 2.00 g. The copolymerization ratio conditions of the resulting copolymer polycarbonate resin (III-13) are shown in Table 4 below.

Manufacturing Example 14

Method of Manufacturing Copolymer Polycarbonate Resin (III-14)

Synthesis was performed as in Manufacturing Example 1 except that the compound represented by Molecular Formula (1-2)-1 in Manufacturing Example 1 was replaced with the compound represented by Molecular Formula (1-1)-1, in the amount of 2.00 g. The copolymerization ratio conditions of the resulting copolymer polycarbonate resin (III-14) are shown in Table 4 below.

Manufacturing Example 15

Method of Manufacturing Copolymer Polycarbonate Resin (III-15)

Synthesis was performed as in Manufacturing Example 14 except that the amount of the bisphenol A in Manufacturing Example 14 was changed to 44.75 g, and the amount of the compound represented by Molecular Formula (1-1)-1 was changed to 4.00 g. The copolymerization ratio conditions of the resulting copolymer polycarbonate resin (III-15) are shown in Table 4 below.

Manufacturing Example 16

Method of Manufacturing Copolymer Polycarbonate Resin (III-16)

Synthesis was performed as in Manufacturing Example 14 except that the amount of the bisphenol A in Manufacturing Example 14 was changed to 45.65 g, and the amount of the compound represented by Molecular Formula (1-1)-1 was changed to 0.02 g. The copolymerization ratio conditions of the resulting copolymer polycarbonate resin (III-16) are shown in Table 4 below.

Manufacturing Example 17

Method of Manufacturing Copolymer Polycarbonate Resin (III-17)

Synthesis was performed as in Manufacturing Example 14 except that the amount of the bisphenol A in Manufacturing Example 14 was changed to 45.61 g, and the amount of the compound represented by Molecular Formula (1-1)-1 was changed to 0.20 g. The copolymerization ratio conditions of the resulting copolymer polycarbonate resin (III-17) are shown in Table 4 below.

Manufacturing Example 18

Method of Manufacturing Copolymer Polycarbonate Resin (III-18)

Synthesis was performed as in Manufacturing Example 1 except that the compound represented by Molecular Formula (1-2)-1 in Manufacturing Example 1 was replaced with the compound represented by Molecular Formula (1-1)-2, in the amount of 10.00 g. The copolymerization ratio conditions of the resulting copolymer polycarbonate resin (III-18) are shown in Table 4 below.

Manufacturing Example 19

Method of Manufacturing Copolymer Polycarbonate Resin (III-19)

Synthesis was performed as in Manufacturing Example 18 except that the amount of the bisphenol A in Manufacturing Example 18 was changed to 44.75 g, and the amount of the compound represented by Molecular Formula (1-1)-2 was changed to 20.00 g. The copolymerization ratio conditions of the resulting copolymer polycarbonate resin (III-19) are shown in Table 4 below.

Manufacturing Example 20

Method of Manufacturing Copolymer Polycarbonate Resin (III-20)

Synthesis was performed as in Manufacturing Example 18 except that the amount of the bisphenol A in Manufacturing Example 18 was changed to 45.65 g, and the amount of the compound represented by Molecular Formula (1-1)-2 was changed to 0.10 g. The copolymerization ratio conditions of the resulting copolymer polycarbonate resin (III-20) are shown in Table 4 below.

Manufacturing Example 21

Method of Manufacturing Copolymer Polycarbonate Resin (III-21)

Synthesis was performed as in Manufacturing Example 18 except that the amount of the bisphenol A in Manufacturing Example 18 was changed to 45.61 g, and the amount of the compound represented by Molecular Formula (1-1)-2 was changed to 1.00 g. The copolymerization ratio conditions of the resulting copolymer polycarbonate resin (III-21) are shown in Table 5 below.

Manufacturing Example 22

Method of Manufacturing Copolymer Polycarbonate Resin (III-22)

Synthesis was performed as in Manufacturing Example 1 except that the compound represented by Molecular Formula (1-2)-1 in Manufacturing Example 1 was replaced with the compound represented by Molecular Formula (1-1)-3, in the amount of 30.00 g. The copolymerization ratio conditions of the resulting copolymer polycarbonate resin (III-22) are shown in Table 5 below.

Manufacturing Example 23

Method of Manufacturing Copolymer Polycarbonate Resin (III-23)

Synthesis was performed as in Manufacturing Example 22 except that the amount of the bisphenol A in Manufacturing Example 22 was changed to 45.61 g, and the amount of the compound represented by Molecular Formula (1-1)-3 was changed to 3.00 g. The copolymerization ratio conditions of the resulting copolymer polycarbonate resin (III-23) are shown in Table 5 below.

Manufacturing Example 24

Method of Manufacturing Copolymer Polycarbonate Resin (III-24)

Synthesis was performed as in Manufacturing Example 22 except that the amount of the bisphenol A in Manufacturing Example 22 was changed to 45.65 g, and the amount of the compound represented by Molecular Formula (1-1)-3 was changed to 0.30 g. The copolymerization ratio conditions of the resulting copolymer polycarbonate resin (III-24) are shown in Table 5 below.

Manufacturing Example 25

Method of manufacturing copolymer polycarbonate resin (III-25)

Synthesis was performed as in Manufacturing Example 22 except that the amount of the bisphenol A in Manufacturing Example 22 was changed to 45.66 g, and the amount of the compound represented by Molecular Formula (1-1)-3 was changed to 0.03 g. The copolymerization ratio conditions of the resulting copolymer polycarbonate resin (III-25) are shown in Table 5 below.

Manufacturing Example 26

Method of Manufacturing Copolymer Polycarbonate Resin (III-26)

Synthesis was performed as in Manufacturing Example 21 except that the bisphenol A represented by Molecular Formula (4)-1 in Table 3 below in Manufacturing Example 21 was replaced with the compound represented by Molecular Formula (4)-2, in the amount of 53.62 g. The copolymerization ratio conditions of the resulting copolymer polycarbonate resin (III-26) are shown in Table 5 below.

Manufacturing Example 27

Method of Manufacturing Copolymer Polycarbonate Resin (III-27)

Synthesis was performed as in Manufacturing Example 21 except that the bisphenol A represented by Molecular Formula (4)-1 in Table 3 below in Manufacturing Example 21 was replaced with the compound represented by Molecular Formula (4)-3, in the amount of 51.22 g. The copolymerization ratio conditions of the resulting copolymer polycarbonate resin (III-27) are shown in Table 5 below.

Manufacturing Example 28

Method of Manufacturing Copolymer Polycarbonate Resin (III-28)

Synthesis was performed as in Manufacturing Example 21 except that the bisphenol A represented by Molecular Formula (4)-1 in Table 3 below in Manufacturing Example 21 was replaced with the compound represented by Molecular Formula (4)-4, in the amount of 48.41 g. The copolymerization ratio conditions of the resulting copolymer polycarbonate resin (III-28) are shown in Table 5 below.

Manufacturing Example 29

Method of Manufacturing Copolymer Polycarbonate Resin (III-29)

Synthesis was performed as in Manufacturing Example 21 except that the bisphenol A represented by Molecular Formula (4)-1 in Table 3 below in Manufacturing Example 21 was replaced with the compound represented by Molecular Formula (4)-5, in the amount of 37.20 g. The copolymerization ratio conditions of the resulting copolymer polycarbonate resin (III-29) are shown in Table 5 below.

Manufacturing Example 30

Method of Manufacturing Copolymer Polycarbonate Resin (III-30)

Synthesis was performed as in Manufacturing Example 21 except that the bisphenol A represented by Molecular Formula (4)-1 in Table 3 below in Manufacturing Example 21 was replaced with the compound represented by Molecular Formula (4)-6, in the amount of 45.21 g. The copolymerization ratio conditions of the resulting copolymer polycarbonate resin (III-30) are shown in Table 5 below.

Manufacturing Example 31

Method of Manufacturing Copolymer Polycarbonate Resin (III-31)

Synthesis was performed as in Manufacturing Example 21 except that the amount of the bisphenol A in Manufacturing Example 21 was changed to 22.81 g, and 26.81 g of the compound represented by Molecular Formula (4)-2 in Table 3 below was also added. The copolymerization ratio conditions of the resulting copolymer polycarbonate resin (III-31) are shown in Table 5 below.

Manufacturing Example 32

Method of Manufacturing Copolymer Polycarbonate Resin (III-32)

Synthesis was performed as in Manufacturing Example 21 except that the amount of the bisphenol A in Manufacturing Example 21 was changed to 6.85 g, and 45.62 g of the compound represented by Molecular Formula (4)-2 in Table 3 below was also added. The copolymerization ratio conditions of the resulting copolymer polycarbonate resin (III-32) are shown in Table 5 below.

Manufacturing Example 33

Method of Manufacturing Copolymer Polycarbonate Resin (III-33)

Synthesis was performed as in Manufacturing Example 21 except that the amount of the bisphenol A in Manufacturing Example 21 was changed to 38.81 g, and 8.05 g of the compound represented by Molecular Formula (4)-2 in Table 3 below was also added. The copolymerization ratio conditions of the resulting copolymer polycarbonate resin (III-33) are shown in Table 5 below.

Manufacturing Example 34

Method of Manufacturing Copolymer Polycarbonate Resin (III-34)

Synthesis was performed as in Manufacturing Example 31 using 22.81 g of the bisphenol A used in Manufacturing Example 31, but with 18.62 g of the compound represented by Molecular Formula (4)-5 in Table 3 below added instead of the compound represented by Molecular Formula (4)-2. The copolymerization ratio conditions of the resulting copolymer polycarbonate resin (III-34) are shown in Table 5 below.

Manufacturing Example 35

Method of Manufacturing Copolymer Polycarbonate Resin (III

Synthesis was performed as in Manufacturing Example 31 except that the amount of the bisphenol A in Manufacturing Example 31 was changed to 6.85 g, and 31.66 g of the compound represented by Molecular Formula (4)-5 in Table 3 below was added instead of the compound represented by Molecular Formula (4)-2. The copolymerization ratio conditions of the resulting copolymer polycarbonate resin (III-35) are shown in Table 5 below.

Manufacturing Example 36

Method of Manufacturing Copolymer Polycarbonate Resin (III-36)

Synthesis was performed as in Manufacturing Example 31 except that the amount of the bisphenol A in Manufacturing Example 31 was changed to 38.81 g, and 5.59 g of the compound represented by Molecular Formula (4)-5 in Table 3 below was added instead of the compound represented by Molecular Formula (4)-2. The copolymerization ratio conditions of the resulting copolymer polycarbonate resin (III-36) are shown in Table 5 below.

Manufacturing Example 37

Method of Manufacturing Copolymer Polycarbonate Resin (III-37)

Synthesis was performed as in Manufacturing Example 31 using 22.81 g of the bisphenol A used in Manufacturing Example 31, but with 22.63 g of the compound represented by Molecular Formula (4)-6 in Table 3 below added instead of the compound represented by Molecular Formula (4)-2. The copolymerization ratio conditions of the resulting copolymer polycarbonate resin (III-37) are shown in Table 5 below.

Manufacturing Example 38

Method of Manufacturing Copolymer Polycarbonate Resin (III-38)

Synthesis was performed as in Manufacturing Example 31 except that the amount of the bisphenol A in Manufacturing Example 31 was changed to 6.85 g, and 38.47 g of the compound represented by Molecular Formula (4)-6 in Table 3 below was added instead of the compound represented by Molecular Formula (4)-2. The copolymerization ratio conditions of the resulting copolymer polycarbonate resin (III-38) are shown in Table 5 below.

Manufacturing Example 39

Method of Manufacturing Copolymer Polycarbonate Resin (III-39)

Synthesis was performed as in Manufacturing Example 31 except that the amount of the bisphenol A in Manufacturing Example 31 was changed to 38.81 g, and 6.79 g of the compound represented by Molecular Formula (4)-6 in Table 3 below was added instead of the compound represented by Molecular Formula (4)-2. The copolymerization ratio conditions of the resulting copolymer polycarbonate resin (III-39) are shown in Table 5 below.

Manufacturing Example 40

Method of Manufacturing Copolymer Polycarbonate Resin (III-40)

Synthesis was performed as in Manufacturing Example 31 using 22.81 g of the bisphenol A used in Manufacturing Example 31, but with 20.02 g of the compound represented by Molecular Formula (4)-7 in Table 3 below was added instead of the compound represented by Molecular Formula (4)-2. The copolymerization ratio conditions of the resulting copolymer polycarbonate resin (III-40) are shown in Table 5 below.

Manufacturing Example 41

Method of Manufacturing Copolymer Polycarbonate Resin (III-41)

Synthesis was performed as in Manufacturing Example 31 except that the amount of the bisphenol A in Manufacturing Example 31 was changed to 6.85 g, and 34.04 g of the compound represented by Molecular Formula (4)-7 in Table 3 below was added instead of the compound represented by Molecular Formula (4)-2. The copolymerization ratio conditions of the resulting copolymer polycarbonate resin (III-41) are shown in Table 5 below.

Manufacturing Example 42

Method of Manufacturing Copolymer Polycarbonate Resin (III-42)

Synthesis was performed as in Manufacturing Example 31 except that the amount of the bisphenol A in Manufacturing Example 31 was changed to 38.81 g, and 6.00 g of the compound represented by Molecular Formula (4)-7 in Table 3 below was added instead of the compound represented by Molecular Formula (4)-2. The copolymerization ratio conditions of the resulting copolymer polycarbonate resin (III-42) are shown in Table 5 below.

Manufacturing Example 43

Method of Manufacturing Copolymer Polycarbonate Resin (III-43)

Synthesis was performed as in Manufacturing Example 31 using 22.81 g of the bisphenol A used in Manufacturing Example 31, but with 29.64 g of the compound represented by Molecular Formula (4)-8 in Table 3 below added instead of the compound represented by Molecular Formula (4)-2. The copolymerization ratio conditions of the resulting copolymer polycarbonate resin (III-43) are shown in Table 6 below.

Manufacturing Example 44

Method of Manufacturing Copolymer Polycarbonate Resin (III-44)

Synthesis was performed as in Manufacturing Example 31 except that the amount of the bisphenol A in Manufacturing Example 31 was changed to 6.85 g, and 50.39 g of the compound represented by Molecular Formula (4)-8 in Table 3 below was added instead of the compound represented by Molecular Formula (4)-2. The copolymerization ratio conditions of the resulting copolymer polycarbonate resin (III-44) are shown in Table 6 below.

Manufacturing Example 45

Method of Manufacturing Copolymer Polycarbonate Resin (III-45)

Synthesis was performed as in Manufacturing Example 31 except that the amount of the bisphenol A in Manufacturing Example 31 was changed to 38.31 g, and 8.89 g of the compound represented by Molecular Formula (4)-8 in Table 3 below was added instead of the compound represented by Molecular Formula (4)-2. The copolymerization ratio conditions of the resulting copolymer polycarbonate resin (III-45) are shown in Table 6 below.

Manufacturing Example 46

Method of Manufacturing Copolymer Polycarbonate Resin (III-46)

Synthesis was performed as in Manufacturing Example 34, but with the bisphenol A represented by Molecular Formula (4)-1 in Table 3 below in Manufacturing Example 34 replaced with the compound represented by Molecular Formula (4)-2, in the amount of 26.84 g. The copolymerization ratio conditions of the resulting copolymer polycarbonate resin (III-46) are shown in Table 6 below.

Manufacturing Example 47

Method of Manufacturing Copolymer Polycarbonate Resin (III-47)

Synthesis was performed as in Manufacturing Example 35, but with the bisphenol A represented by Molecular Formula (4)-1 in Table 3 below in Manufacturing Example 35 replaced with the compound represented by Molecular Formula (4)-2, in the amount of 8.05 g. The copolymerization ratio conditions of the resulting copolymer polycarbonate resin (III-47) are shown in Table 6 below.

Manufacturing Example 48

Method of Manufacturing Copolymer Polycarbonate Resin (III-48)

Synthesis was performed as in Manufacturing Example 36, but with the bisphenol A represented by Molecular Formula (4)-1 in Table 3 below in Manufacturing Example 36 replaced with the compound represented by Molecular Formula (4)-2, in the amount of 45.62 g. The copolymerization ratio conditions of the resulting copolymer polycarbonate resin (III-48) are shown in Table 6 below.

Manufacturing Example 49

Method of Manufacturing Copolymer Polycarbonate Resin (III-49)

Synthesis was performed as in Manufacturing Example 37, but with the bisphenol A represented by Molecular Formula (4)-1 in Table 3 below in Manufacturing Example 37 replaced with the compound represented by Molecular Formula (4)-2, in the amount of 26.84 g. The copolymerization ratio conditions of the resulting copolymer polycarbonate resin (III-49) are shown in Table 6 below.

Manufacturing Example 50

Method of Manufacturing Copolymer Polycarbonate Resin (III-50)

Synthesis was performed as in Manufacturing Example 38, but with the bisphenol A represented by Molecular Formula (4)-1 in Table 3 below in Manufacturing Example 38 replaced with the compound represented by Molecular Formula (4)-2, in the amount of 8.05 g. The copolymerization ratio conditions of the resulting copolymer polycarbonate resin (III-50) are shown in Table 6 below.

Manufacturing Example 5

Method of Manufacturing Copolymer Polycarbonate Resin (III-51)

Synthesis was performed as in Manufacturing Example 39, but with the bisphenol A represented by Molecular Formula (4)-1 in Table 3 below in Manufacturing Example 39 replaced with the compound represented by Molecular Formula (4)-2, in the amount of 45.62 g. The copolymerization ratio conditions of the resulting copolymer polycarbonate resin (III-51) are shown in Table 6 below.

Manufacturing Example 52

Method of Manufacturing Copolymer Polycarbonate Resin (III-52)

Synthesis was performed as in Manufacturing Example 40, but with the bisphenol A represented by Molecular Formula (4)-1 in Table 3 below in Manufacturing Example 40 replaced with the compound represented by Molecular Formula (4)-2, in the amount of 26.84 g. The copolymerization ratio conditions of the resulting copolymer polycarbonate resin (III-52) are shown in Table 6 below.

Manufacturing Example 53

Method of Manufacturing Copolymer Polycarbonate Resin (III-53)

Synthesis was performed as in Manufacturing Example 41, but with the bisphenol A represented by Molecular Formula (4)-1 in Table 3 below in Manufacturing Example 41 replaced with the compound represented by Molecular Formula (4)-2, in the amount of 8.05 g. The copolymerization ratio conditions of the resulting copolymer polycarbonate resin (III-53) are shown in Table 6 below.

Manufacturing Example 54

Method of Manufacturing Copolymer Polycarbonate Resin (III-54)

Synthesis was performed as in Manufacturing Example 42, but with the bisphenol A represented by Molecular Formula (4)-1 in Table 3 below in Manufacturing Example 42 replaced with the compound represented by Molecular Formula (4)-2, in the amount of 45.62 g. The copolymerization ratio conditions of the resulting copolymer polycarbonate resin (III-54) are shown in Table 6 below.

Manufacturing Example 55

Method of Manufacturing Copolymer Polycarbonate Resin (III-55)

Synthesis was performed as in Manufacturing Example 40, but with the bisphenol A represented by Molecular Formula (4)-1 in Table 3 below in Manufacturing Example 40 replaced with the compound represented by Molecular Formula (4)-3, in the amount of 25.63 g. The copolymerization ratio conditions of the resulting copolymer polycarbonate resin (III-55) are shown in Table 6 below.

Manufacturing Example 56

Method of Manufacturing Copolymer Polycarbonate Resin (III-56)

Synthesis was performed as in Manufacturing Example 41, but with the bisphenol A represented by Molecular Formula (4)-1 in Table 3 below in Manufacturing Example 41 replaced with the compound represented by Molecular Formula (4)-3, in the amount of 7.69 g. The copolymerization ratio conditions of the resulting copolymer polycarbonate resin (III-56) are shown in Table 6 below.

Manufacturing Example 57

Method of Manufacturing Copolymer Polycarbonate Resin (III 57)

Synthesis was performed as in Manufacturing Example 42, but with the bisphenol A represented by Molecular Formula (4)-1 in Table 3 below in Manufacturing Example 42 replaced with the compound represented by Molecular Formula (4)-3, in the amount of 43.58 g. The copolymerization ratio conditions of the resulting copolymer polycarbonate resin (III-57) are shown in Table 6 below.

Manufacturing Example 58

Method of Manufacturing Polycarbonate Resin (III-58)

Synthesis was performed as in Manufacturing Example 1, except that the amount of bisphenol A in Manufacturing Example 1 was changed to 45.66 g, and the reaction was performed without the addition of the compound represented by Molecular Formula (1-2)-1. The copolymerization ratio conditions of the resulting copolymer polycarbonate resin (III-58) are shown in Table 6 below.

Manufacturing Example 59

Method of Manufacturing Polycarbonate Resin (III-59)

Synthesis was performed as in Manufacturing Example 58 except that the bisphenol A represented by Molecular Formula (4)-1 in Table 3 below in Manufacturing Example 58 was replaced by the compound represented by Molecular Formula (4)-2, in the amount of 53.67 g. The copolymerization ratio conditions of the resulting copolymer polycarbonate resin (III-59) are shown in Table 6 below.

Manufacturing Example 60

Method of Manufacturing Polycarbonate Resin (III-60)

Synthesis was performed as in Manufacturing Example 58 except that the bisphenol A represented by Molecular Formula (4)-1 in Table 3 below in Manufacturing Example 58 was replaced by the compound represented by Molecular Formula (4)-3, in the amount of 51.27 g. The copolymerization ratio conditions of the resulting copolymer polycarbonate resin (III-60) are shown in Table 6 below.

Manufacturing Example 61

Method of Manufacturing Polycarbonate Resin (III-61)

Synthesis was performed as in Manufacturing Example 58 except that the bisphenol A represented by Molecular Formula (4)-1 in Table 3 below in Manufacturing Example 58 was replaced by the compound represented by Molecular Formula (4)-4, in the amount of 48.46 g. The copolymerization ratio conditions of the resulting copolymer polycarbonate resin (III-61) are shown in Table 6 below.

Manufacturing Example 62

Method of Manufacturing Polycarbonate Resin (III-62)

Synthesis was performed as in Manufacturing Example 58 except that the bisphenol A represented by Molecular Formula (4)-1 in Table 3 below in Manufacturing Example 58 was replaced by the compound represented by Molecular Formula (4)-5, in the amount of 37.24 g. The copolymerization ratio conditions of the resulting copolymer polycarbonate resin (III-62) are shown in Table 6 below.

Manufacturing Example 63

Method of Manufacturing Polycarbonate Resin (III-63)

Synthesis was performed as in Manufacturing Example 58 except that the bisphenol A represented by Molecular Formula (4)-1 in Table 3 below in Manufacturing Example 58 was replaced by the compound represented by Molecular Formula (4)-6, in the amount of 45.25 g. The copolymerization ratio conditions of the resulting copolymer polycarbonate resin (III-63) are shown in Table 6 below.

TABLE 3

| | :Molecular formula |
|---|---|
| (4)-1 | 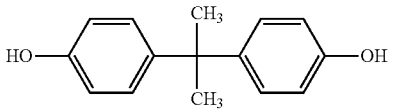 |
| (4)-2 | 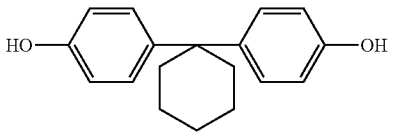 |
| (4)-3 | 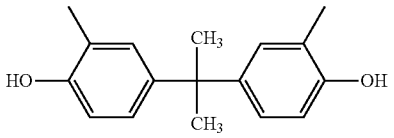 |
| (4)-4 | 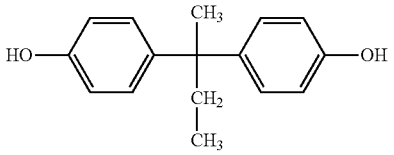 |

TABLE 3-continued

| | :Molecular formula |
|---|---|
| (4)-5 | 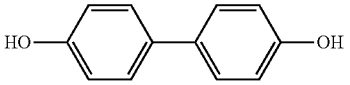 |
| (4)-6 | 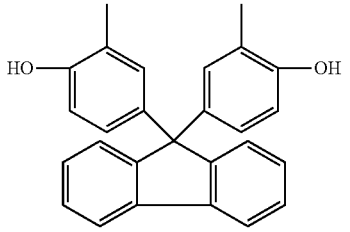 |
| (4)-7 | 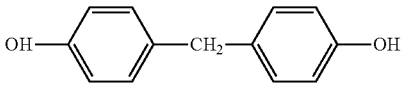 |
| (4)-8 | 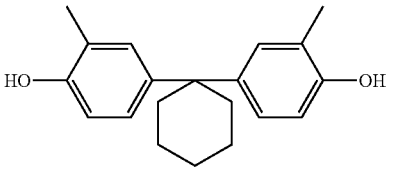 |

TABLE 4

| | | Siloxane component a | | Bisphenol component (1) b | | Bisphenol component (2) b | | Polymer ratio (mol %) | |
|---|---|---|---|---|---|---|---|---|---|
| | Resin | Type | mol | Type | mol | Type | mol | a | b |
| ME 1 | (III-1) | (1-2)-1 | 0.00200 | (4)-1 | 0.198 | — | 0.000 | 1.000 | 99.000 |
| ME 2 | (III-2) | (1-2)-1 | 0.00400 | (4)-1 | 0.196 | — | 0.000 | 2.000 | 98.000 |
| ME 3 | (III-3) | (1-2)-1 | 0.02000 | (4)-1 | 0.180 | — | 0.000 | 10.000 | 90.000 |
| ME 4 | (III-4) | (1-2)-1 | 0.00020 | (4)-1 | 0.200 | — | 0.000 | 0.100 | 99.900 |
| ME 5 | (III-5) | (1-2)-1 | 0.00002 | (4)-1 | 0.200 | — | 0.000 | 0.010 | 99.990 |
| ME 6 | (III-6) | (1-2)-2 | 0.00200 | (4)-1 | 0.198 | — | 0.000 | 1.000 | 99.000 |
| ME 7 | (III-7) | (1-2)-2 | 0.00400 | (4)-1 | 0.196 | — | 0.000 | 2.000 | 98.000 |
| ME 8 | (III-8) | (1-2)-2 | 0.00020 | (4)-1 | 0.200 | — | 0.000 | 0.100 | 99.900 |
| ME 9 | (III-9) | (1-2)-2 | 0.00002 | (4)-1 | 0.200 | — | 0.000 | 0.010 | 99.990 |
| ME 10 | (III-10) | (1-2)-3 | 0.00200 | (4)-1 | 0.198 | — | 0.000 | 1.000 | 99.000 |
| ME 11 | (III-11) | (1-2)-3 | 0.00400 | (4)-1 | 0.196 | — | 0.000 | 2.000 | 98.000 |
| ME 12 | (III-12) | (1-2)-3 | 0.00002 | (4)-1 | 0.200 | — | 0.000 | 0.010 | 99.990 |
| ME 13 | (III-13) | (1-2)-3 | 0.00020 | (4)-1 | 0.200 | — | 0.000 | 0.100 | 99.900 |
| ME 14 | (III-14) | (1-1)-1 | 0.00200 | (4)-1 | 0.198 | — | 0.000 | 1.000 | 99.000 |
| ME 15 | (III-15) | (1-1)-1 | 0.00400 | (4)-1 | 0.196 | — | 0.000 | 2.000 | 98.000 |
| ME 16 | (III-16) | (1-1)-1 | 0.00002 | (4)-1 | 0.200 | — | 0.000 | 0.010 | 99.990 |
| ME 17 | (III-17) | (1-1)-1 | 0.00020 | (4)-1 | 0.200 | — | 0.000 | 0.100 | 99.900 |
| ME 18 | (III-18) | (1-1)-2 | 0.00200 | (4)-1 | 0.198 | — | 0.000 | 1.000 | 99.000 |
| ME 19 | (III-19) | (1-1)-2 | 0.00400 | (4)-1 | 0.196 | — | 0.000 | 2.000 | 98.000 |
| ME 20 | (III-20) | (1-1)-2 | 0.00002 | (4)-1 | 0.200 | — | 0.000 | 0.010 | 99.990 |

TABLE 5

| | | Siloxane component a | | Bisphenol component (1) b | | Bisphenol component (2) b | | Polymer ratio (mol %) | |
|---|---|---|---|---|---|---|---|---|---|
| | Resin | Type | mol | Type | mol | Type | mol | a | b |
| ME 21 | (III-21) | (1-1)-2 | 0.00020 | (4)-1 | 0.200 | — | 0.000 | 0.100 | 99.900 |
| ME 22 | (III-22) | (1-1)-3 | 0.00200 | (4)-1 | 0.198 | — | 0.000 | 1.000 | 99.000 |
| ME 23 | (III-23) | (1-1)-3 | 0.00020 | (4)-1 | 0.200 | — | 0.000 | 0.100 | 99.900 |
| ME 24 | (III-24) | (1-1)-3 | 0.00002 | (4)-1 | 0.200 | — | 0.000 | 0.010 | 99.990 |
| ME 25 | (III-25) | (1-1)-3 | 0.00000 | (4)-1 | 0.200 | — | 0.000 | 0.001 | 99.999 |
| ME 26 | (III-26) | (1-1)-2 | 0.00020 | (4)-2 | 0.200 | — | 0.000 | 0.100 | 99.900 |

TABLE 5-continued

| | | Siloxane component a | | Bisphenol component (1) b | | Bisphenol component (2) b | | Polymer ratio (mol %) | |
|---|---|---|---|---|---|---|---|---|---|
| | Resin | Type | mol | Type | mol | Type | mol | a | b |
| ME 27 | (III-27) | (1-1)-2 | 0.00020 | (4)-3 | 0.200 | — | 0.000 | 0.100 | 99.900 |
| ME 28 | (III-28) | (1-1)-2 | 0.00020 | (4)-4 | 0.200 | — | 0.000 | 0.100 | 99.900 |
| ME 29 | (III-29) | (1-1)-2 | 0.00020 | (4)-5 | 0.200 | — | 0.000 | 0.100 | 99.900 |
| ME 30 | (III-30) | (1-1)-2 | 0.00020 | (4)-6 | 0.200 | — | 0.000 | 0.100 | 99.900 |
| ME 31 | (III-31) | (1-1)-2 | 0.00020 | (4)-1 | 0.100 | (4)-2 | 0.100 | 0.100 | 99.900 |
| ME 32 | (III-32) | (1-1)-2 | 0.00020 | (4)-1 | 0.030 | (4)-2 | 0.170 | 0.100 | 99.900 |
| ME 33 | (III-33) | (1-1)-2 | 0.00020 | (4)-1 | 0.170 | (4)-2 | 0.030 | 0.100 | 99.900 |
| ME 34 | (III-34) | (1-1)-2 | 0.00020 | (4)-1 | 0.100 | (4)-5 | 0.100 | 0.100 | 99.900 |
| ME 35 | (III-35) | (1-1)-2 | 0.00020 | (4)-1 | 0.030 | (4)-5 | 0.170 | 0.100 | 99.900 |
| ME 36 | (III-36) | (1-1)-2 | 0.00020 | (4)-1 | 0.170 | (4)-5 | 0.030 | 0.100 | 99.900 |
| ME 37 | (III-37) | (1-1)-2 | 0.00020 | (4)-1 | 0.100 | (4)-6 | 0.100 | 0.100 | 99.900 |
| ME 38 | (III-38) | (1-1)-2 | 0.00020 | (4)-1 | 0.030 | (4)-6 | 0.170 | 0.100 | 99.900 |
| ME 39 | (III-39) | (1-1)-2 | 0.00020 | (4)-1 | 0.170 | (4)-6 | 0.030 | 0.100 | 99.900 |
| ME 40 | (III-40) | (1-1)-2 | 0.00020 | (4)-1 | 0.100 | (4)-7 | 0.100 | 0.100 | 99.900 |
| ME 41 | (III-41) | (1-1)-2 | 0.00020 | (4)-1 | 0.030 | (4)-7 | 0.170 | 0.100 | 99.900 |
| ME 42 | (III-42) | (1-1)-2 | 0.00020 | (4)-1 | 0.170 | (4)-7 | 0.030 | 0.100 | 99.900 |

TABLE 6

| | | Siloxane component a | | Bisphenol component (1) b | | Bisphenol component (2) b | | Polymer ratio (mol %) | |
|---|---|---|---|---|---|---|---|---|---|
| | Resin | Type | mol | Type | mol | Type | mol | a | b |
| ME 43 | (III-43) | (1-1)-2 | 0.00020 | (4)-1 | 0.100 | (4)-8 | 0.100 | 0.100 | 99.900 |
| ME 44 | (III-44) | (1-1)-2 | 0.00020 | (4)-1 | 0.030 | (4)-8 | 0.170 | 0.100 | 99.900 |
| ME 45 | (III-45) | (1-1)-2 | 0.00020 | (4)-1 | 0.170 | (4)-8 | 0.030 | 0.100 | 99.900 |
| ME 46 | (III-46) | (1-1)-2 | 0.00020 | (4)-2 | 0.100 | (4)-5 | 0.100 | 0.100 | 99.900 |
| ME 47 | (III-47) | (1-1)-2 | 0.00020 | (4)-2 | 0.030 | (4)-5 | 0.170 | 0.100 | 99.900 |
| ME 48 | (III-48) | (1-1)-2 | 0.00020 | (4)-2 | 0.170 | (4)-5 | 0.030 | 0.100 | 99.900 |
| ME 49 | (III-49) | (1-1)-2 | 0.00020 | (4)-2 | 0.100 | (4)-6 | 0.100 | 0.100 | 99.900 |
| ME 50 | (III-50) | (1-1)-2 | 0.00020 | (4)-2 | 0.030 | (4)-6 | 0.170 | 0.100 | 99.900 |
| ME 51 | (III-51) | (1-1)-2 | 0.00020 | (4)-2 | 0.170 | (4)-6 | 0.030 | 0.100 | 99.900 |
| ME 52 | (III-52) | (1-1)-2 | 0.00020 | (4)-2 | 0.100 | (4)-7 | 0.100 | 0.100 | 99.900 |
| ME 53 | (III-53) | (1-1)-2 | 0.00020 | (4)-2 | 0.030 | (4)-7 | 0.170 | 0.100 | 99.900 |
| ME 54 | (III-54) | (1-1)-2 | 0.00020 | (4)-2 | 0.170 | (4)-7 | 0.030 | 0.100 | 99.900 |
| ME 55 | (III-55) | (1-1)-2 | 0.00020 | (4)-3 | 0.100 | (4)-7 | 0.100 | 0.100 | 99.900 |
| ME 56 | (III-56) | (1-1)-2 | 0.00020 | (4)-3 | 0.030 | (4)-7 | 0.170 | 0.100 | 99.900 |
| ME 57 | (III-57) | (1-1)-2 | 0.00020 | (4)-3 | 0.170 | (4)-7 | 0.030 | 0.100 | 99.900 |
| ME 58 | (III-58) | — | 0.00000 | (4)-1 | 0.200 | — | 0.000 | 0.000 | 100.000 |
| ME 59 | (III-59) | — | 0.00000 | (4)-2 | 0.200 | — | 0.000 | 0.000 | 100.000 |
| ME 60 | (III-60) | — | 0.00000 | (4)-3 | 0.200 | — | 0.000 | 0.000 | 100.000 |
| ME 61 | (III-61) | — | 0.00000 | (4)-4 | 0.200 | — | 0.000 | 0.000 | 100.000 |
| ME 62 | (III-62) | — | 0.00000 | (4)-5 | 0.200 | — | 0.000 | 0.000 | 100.000 |
| ME 63 | (III-63) | — | 0.00000 | (4)-6 | 0.200 | — | 0.000 | 0.000 | 100.000 |

Manufacture of Negatively-Charged Stacked Photoreceptor

Example 1

3 mass parts of alcohol-soluble nylon (Toray CM8000™) and 7 mass parts of aminosilane-treated titanium oxide fine particles were dissolved and dispersed in 90 mass parts of methanol to prepare a coating liquid A. This coating liquid A was dip coated on the outer circumference of an aluminum cylinder with an outer diameter of 30 mm as a conductive substrate 1, and dried for 30 minutes at 100° C. to form a base coat layer 2 with a thickness of 3 μm.

1 mass part of Y-type titanyl phthalocyanine as a charge generating material and 1.5 mass parts of polyvinyl butyral resin (Eslec™ KS-1, manufactured by Sekisui Chemical) as a resin binder were dissolved and dispersed in 60 mass parts of dichloromethane to prepare a coating liquid B. This coating liquid B was dip coated on the base coat layer 2 described above and dried for 30 minutes at 80° C. to form a charge generating layer 4 with a thickness of 0.25 μm.

90 mass parts of the compound represented by the following formula:

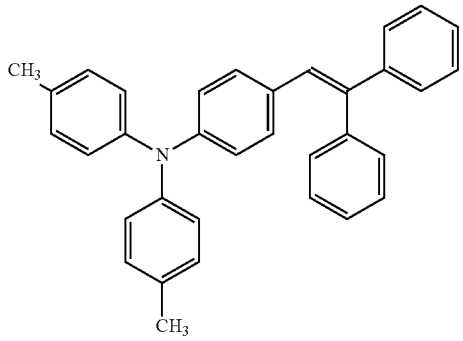

as a charge transport material and 110 mass parts of the copolymer polycarbonate resin (III-1) of Manufacturing Example 1 above as a resin binder were dissolved in 1000 mass parts of dichloromethane to prepare a coating liquid C. The coating liquid C was dip coated on the aforementioned charge generating layer 4 and dried for 60 minutes at 90° C. to form a charge transport layer 5 with a thickness of 25 μm and prepare a negatively-charged stacked photoreceptor.

Example 2

A photoreceptor was prepared by methods similar to those of Example 1 except that the copolymer polycarbonate resin (III-2) produced in Manufacturing Example 2 was substituted for the copolymer polycarbonate resin (III-1) of Manufacturing Example 1 used in Example 1.

Example 3

A photoreceptor was prepared by methods similar to those of Example 1 except that the copolymer polycarbonate resin (III-3) produced in Manufacturing Example 3 was substituted for the copolymer polycarbonate resin (III-1) of Manufacturing Example 1 used in Example 1.

Example 4

A photoreceptor was prepared by methods similar to those of Example 1 except that the copolymer polycarbonate resin (III-4) produced in Manufacturing Example 4 was substituted for the copolymer polycarbonate resin (III-1) of Manufacturing Example 1 used in Example 1.

Example 5

A photoreceptor was prepared by methods similar to those of Example 1 except that the copolymer polycarbonate resin (III-5) produced in Manufacturing Example 5 was substituted for the copolymer polycarbonate resin (III-1) of Manufacturing Example 1 used in Example 1.

Example 6

A photoreceptor was prepared by methods similar to those of Example 1 except that the copolymer polycarbonate resin (III-6) produced in Manufacturing Example 6 was substituted for the copolymer polycarbonate resin (III-1) of Manufacturing Example 1 used in Example 1.

Example 7

A photoreceptor was prepared by methods similar to those of Example 1 except that the copolymer polycarbonate resin (III-7) produced in Manufacturing Example 7 was substituted for the copolymer polycarbonate resin (III-1) of Manufacturing Example 1 used in Example 1.

Example 8

A photoreceptor was prepared by methods similar to those of Example 1 except that the copolymer polycarbonate resin (III-8) produced in Manufacturing Example 8 was substituted for the copolymer polycarbonate resin (III-1) of Manufacturing Example 1 used in Example 1.

Example 9

A photoreceptor was prepared by methods similar to those of Example 1 except that the copolymer polycarbonate resin (III-9) produced in Manufacturing Example 9 was substituted for the copolymer polycarbonate resin (III-1) of Manufacturing Example 1 used in Example 1.

Example 10

A photoreceptor was prepared by methods similar to those of Example 1 except that the copolymer polycarbonate resin (III-10) produced in Manufacturing Example 10 was substituted for the copolymer polycarbonate resin (III-1) of Manufacturing Example 1 used in Example 1.

Example 11

A photoreceptor was prepared by methods similar to those of Example 1 except that the copolymer polycarbonate resin (III-11) produced in Manufacturing Example 11 was substituted for the copolymer polycarbonate resin (III-1) of Manufacturing Example 1 used in Example 1.

Example 12

A photoreceptor was prepared by methods similar to those of Example 1 except that the copolymer polycarbonate resin (III-12) produced in Manufacturing Example 12 was substituted for the copolymer polycarbonate resin (III-1) of Manufacturing Example 1 used in Example 1.

Example 13

A photoreceptor was prepared by methods similar to those of Example 1 except that the copolymer polycarbonate resin (III-13) produced in Manufacturing Example 13 was substituted for the copolymer polycarbonate resin (III-1) of Manufacturing Example 1 used in Example 1.

Example 14

A photoreceptor was prepared by methods similar to those of Example 1 except that the copolymer polycarbonate resin (III-14) produced in Manufacturing Example 14 was substituted for the copolymer polycarbonate resin (III-1) of Manufacturing Example 1 used in Example 1.

Example 15

A photoreceptor was prepared by methods similar to those of Example 1 except that the copolymer polycarbonate resin (III-15) produced in Manufacturing Example 15 was substituted for the copolymer polycarbonate resin (III-1) of Manufacturing Example 1 used in Example 1.

Example 16

A photoreceptor was prepared by methods similar to those of Example 1 except that the copolymer polycarbonate resin (III-16) produced in Manufacturing Example 16 was substituted for the copolymer polycarbonate resin (III-1) of Manufacturing Example 1 used in Example 1.

Example 17

A photoreceptor was prepared by methods similar to those of Example 1 except that the copolymer polycarbonate resin (III-17) produced in Manufacturing Example 17 was substituted for the copolymer polycarbonate resin (III-1) of Manufacturing Example 1 used in Example 1.

Example 18

A photoreceptor was prepared by methods similar to those of Example 1 except that the copolymer polycarbonate resin (III-18) produced in Manufacturing Example 18 was substituted for the copolymer polycarbonate resin (III-1) of Manufacturing Example 1 used in Example 1.

Example 19

A photoreceptor was prepared by methods similar to those of Example 1 except that the copolymer polycarbonate resin (III-19) produced in Manufacturing Example 19 was substituted for the copolymer polycarbonate resin (III-1) of Manufacturing Example 1 used in Example 1.

Example 20

A photoreceptor was prepared by methods similar to those of Example 1 except that the copolymer polycarbonate resin (III-20) produced in Manufacturing Example 20 was substituted for the copolymer polycarbonate resin (III-1) of Manufacturing Example 1 used in Example 1.

Example 21

A photoreceptor was prepared by methods similar to those of Example 1 except that the copolymer polycarbonate resin (III-21) produced in Manufacturing Example 21 was substituted for the copolymer polycarbonate resin (III-1) of Manufacturing Example 1 used in Example 1.

Example 22

A photoreceptor was prepared by methods similar to those of Example 1 except that the copolymer polycarbonate resin (III-22) produced in Manufacturing Example 22 was substituted for the copolymer polycarbonate resin (III-1) of Manufacturing Example 1 used in Example 1.

Example 23

A photoreceptor was prepared by methods similar to those of Example 1 except that the copolymer polycarbonate resin (III-23) produced in Manufacturing Example 23 was substituted for the copolymer polycarbonate resin (III-1) of Manufacturing Example 1 used in Example 1.

Example 24

A photoreceptor was prepared by methods similar to those of Example 1 except that the copolymer polycarbonate resin (III-24) produced in Manufacturing Example 24 was substituted for the copolymer polycarbonate resin (III-1) of Manufacturing Example 1 used in Example 1.

Example 25

A photoreceptor was prepared by methods similar to those of Example 1 except that the copolymer polycarbonate resin (III-25) produced in Manufacturing Example 25 was substituted for the copolymer polycarbonate resin (III-1) of Manufacturing Example 1 used in Example 1.

Example 26

A photoreceptor was prepared by methods similar to those of Example 1 except that the copolymer polycarbonate resin (III-26) produced in Manufacturing Example 26 was substituted for the copolymer polycarbonate resin (III-1) of Manufacturing Example 1 used in Example 1.

Example 27

A photoreceptor was prepared by methods similar to those of Example 1 except that the copolymer polycarbonate resin (III-27) produced in Manufacturing Example 27 was substituted for the copolymer polycarbonate resin (III-1) of Manufacturing Example 1 used in Example 1.

Example 28

A photoreceptor was prepared by methods similar to those of Example 1 except that the copolymer polycarbonate resin (III-28) produced in Manufacturing Example 28 was substituted for the copolymer polycarbonate resin (III-1) of Manufacturing Example 1 used in Example 1.

Example 29

A photoreceptor was prepared by methods similar to those of Example 1 except that the copolymer polycarbonate resin (III-29) produced in Manufacturing Example 29 was substituted for the copolymer polycarbonate resin (III-1) of Manufacturing Example 1 used in Example 1.

Example 30

A photoreceptor was prepared by methods similar to those of Example 1 except that the copolymer polycarbonate resin (III-30) produced in Manufacturing Example 30 was substituted for the copolymer polycarbonate resin (III-1) of Manufacturing Example 1 used in Example 1.

Example 31

A photoreceptor was prepared by methods similar to those of Example 1 except that the copolymer polycarbonate resin (III-31) produced in Manufacturing Example 31 was substituted for the copolymer polycarbonate resin (III-1) of Manufacturing Example 1 used in Example 1.

Example 32

A photoreceptor was prepared by methods similar to those of Example 1 except that the copolymer polycarbonate resin (III-32) produced in Manufacturing Example 32 was substituted for the copolymer polycarbonate resin (III-1) of Manufacturing Example 1 used in Example 1.

Example 33

A photoreceptor was prepared by methods similar to those of Example 1 except that the copolymer polycarbonate resin (III-33) produced in Manufacturing Example 33 was substituted for the copolymer polycarbonate resin (III-1) of Manufacturing Example 1 used in Example 1.

Example 34

A photoreceptor was prepared by methods similar to those of Example 1 except that the copolymer polycarbonate resin (III-34) produced in Manufacturing Example 34 was substituted for the copolymer polycarbonate resin (III-1) of Manufacturing Example 1 used in Example 1.

Example 35

A photoreceptor was prepared by methods similar to those of Example 1 except that the copolymer polycarbonate resin (III-35) produced in Manufacturing Example 35 was substituted for the copolymer polycarbonate resin (III-1) of Manufacturing Example 1 used in Example 1.

Example 36

A photoreceptor was prepared by methods similar to those of Example 1 except that the copolymer polycarbonate resin (III-36) produced in Manufacturing Example 36 was substituted for the copolymer polycarbonate resin (III-1) of Manufacturing Example 1 used in Example 1.

Example 37

A photoreceptor was prepared by methods similar to those of Example 1 except that the copolymer polycarbonate resin (III-37) produced in Manufacturing Example 37 was substituted for the copolymer polycarbonate resin (III-1) of Manufacturing Example 1 used in Example 1.

Example 38

A photoreceptor was prepared by methods similar to those of Example 1 except that the copolymer polycarbonate resin (III-38) produced in Manufacturing Example 38 was substituted for the copolymer polycarbonate resin (III-1) of Manufacturing Example 1 used in Example 1.

Example 39

A photoreceptor was prepared by methods similar to those of Example 1 except that the copolymer polycarbonate resin (III-39) produced in Manufacturing Example 39 was substituted for the copolymer polycarbonate resin (III-1) of Manufacturing Example 1 used in Example 1.

Example 40

A photoreceptor was prepared by methods similar to those of Example 1 except that the copolymer polycarbonate resin (III-40) produced in Manufacturing Example 40 was substituted for the copolymer polycarbonate resin (III-1) of Manufacturing Example 1 used in Example 1.

Example 41

A photoreceptor was prepared by methods similar to those of Example 1 except that the copolymer polycarbonate resin (III-41) produced in Manufacturing Example 41 was substituted for the copolymer polycarbonate resin (III-1) of Manufacturing Example 1 used in Example 1.

Example 42

A photoreceptor was prepared by methods similar to those of Example 1 except that the copolymer polycarbonate resin (III-42) produced in Manufacturing Example 42 was substituted for the copolymer polycarbonate resin (III-1) of Manufacturing Example 1 used in Example 1.

Example 43

A photoreceptor was prepared by methods similar to those of Example 1 except that the copolymer polycarbonate resin (III-43) produced in Manufacturing Example 43 was substituted for the copolymer polycarbonate resin (III-1) of Manufacturing Example 1 used in Example 1.

Example 44

A photoreceptor was prepared by methods similar to those of Example 1 except that the copolymer polycarbonate resin (III-44) produced in Manufacturing Example 44 was substituted for the copolymer polycarbonate resin (III-1) of Manufacturing Example 1 used in Example 1.

Example 45

A photoreceptor was prepared by methods similar to those of Example 1 except that the copolymer polycarbonate resin (III-45) produced in Manufacturing Example 45 was substituted for the copolymer polycarbonate resin (III-1) of Manufacturing Example 1 used in Example 1.

Example 46

A photoreceptor was prepared by methods similar to those of Example 1 except that the copolymer polycarbonate resin (III-46) produced in Manufacturing Example 46 was substituted for the copolymer polycarbonate resin (III-1) of Manufacturing Example 1 used in Example 1.

Example 47

A photoreceptor was prepared by methods similar to those of Example 1 except that the copolymer polycarbonate resin (III-47) produced in Manufacturing Example 47 was substituted for the copolymer polycarbonate resin (III-1) of Manufacturing Example 1 used in Example 1.

Example 48

A photoreceptor was prepared by methods similar to those of Example 1 except that the copolymer polycarbonate resin (III-48) produced in Manufacturing Example 48 was substituted for the copolymer polycarbonate resin (III-1) of Manufacturing Example 1 used in Example 1.

Example 49

A photoreceptor was prepared by methods similar to those of Example 1 except that the copolymer polycarbonate resin (III-49) produced in Manufacturing Example 49 was substituted for the copolymer polycarbonate resin (III-1) of Manufacturing Example 1 used in Example 1.

Example 50

A photoreceptor was prepared by methods similar to those of Example 1 except that the copolymer polycarbonate resin (III-50) produced in Manufacturing Example 50 was substituted for the copolymer polycarbonate resin (III-1) of Manufacturing Example 1 used in Example 1.

Example 51

A photoreceptor was prepared by methods similar to those of Example 1 except that the copolymer polycarbonate resin (III-51) produced in Manufacturing Example 51 was substituted for the copolymer polycarbonate resin (III-1) of Manufacturing Example 1 used in Example 1.

Example 52

A photoreceptor was prepared by methods similar to those of Example 1 except that the copolymer polycarbonate resin (III-52) produced in Manufacturing Example 52 was substituted for the copolymer polycarbonate resin (III-1) of Manufacturing Example 1 used in Example 1.

Example 53

A photoreceptor was prepared by methods similar to those of Example 1 except that the copolymer polycarbonate resin (III-53) produced in Manufacturing Example 53 was substituted for the copolymer polycarbonate resin (III-1) of Manufacturing Example 1 used in Example 1.

Example 54

A photoreceptor was prepared by methods similar to those of Example 1 except that the copolymer polycarbonate resin (III-54) produced in Manufacturing Example 54 was substituted for the copolymer polycarbonate resin (III-1) of Manufacturing Example 1 used in Example 1.

Example 55

A photoreceptor was prepared by methods similar to those of Example 1 except that the copolymer polycarbonate resin (III-55) produced in Manufacturing Example 55 was substituted for the copolymer polycarbonate resin (III-1) of Manufacturing Example 1 used in Example 1.

Example 56

A photoreceptor was prepared by methods similar to those of Example 1 except that the copolymer polycarbonate resin (III-56) produced in Manufacturing Example 56 was substituted for the copolymer polycarbonate resin (III-1) of Manufacturing Example 1 used in Example 1.

Example 57

A photoreceptor was prepared by methods similar to those of Example 1 except that the copolymer polycarbonate resin (III-57) produced in Manufacturing Example 57 was substituted for the copolymer polycarbonate resin (III-1) of Manufacturing Example 1 used in Example 1.

Example 58

A photoreceptor was prepared by methods similar to those of Example 1 except that α-type titanyl phthalocyanine was substituted for the Y-type titanyl phthalocyanine used in Example 1.

Example 59

A photoreceptor was prepared by methods similar to those of Example 1 except that the compound represented by the following formula:

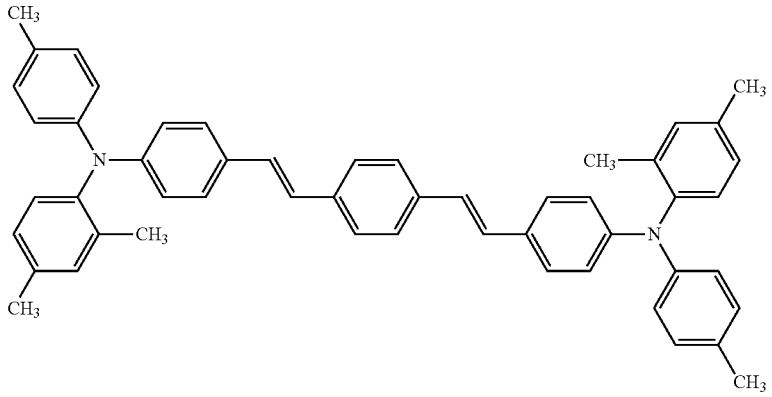

was substituted for the charge transport material used in Example 1.

Example 60

A photoreceptor was prepared by methods similar to those of Example 1 except that the amount of the resin (III-1) used in Example 1 was changed to 22 mass parts, and 88 mass parts of polycarbonate Z (Mitsubishi Gas Chemical PCZ-500™, called "III-64" below) were added to the coating liquid for the charge transport layer.

Example 61

A photoreceptor was prepared by methods similar to those of Example 1 except that the amount of the resin (III-1) used in Example 1 was changed to 22 mass parts, and 88 mass parts of polycarbonate A (Mitsubishi Engineering Plastic S-3000™, called "III-65" below) were added to the coating liquid for the charge transport layer.

Comparative Example 1

A photoreceptor was prepared by methods similar to those of Example 1 except that the copolymer polycarbonate resin (III-58) produced in Manufacturing Example 58 was substituted for the copolymer polycarbonate resin (III-1) of Manufacturing Example 1 used in Example 1.

Comparative Example 2

A photoreceptor was prepared by methods similar to those of Example 1 except that the copolymer polycarbonate resin (III-59) produced in Manufacturing Example 59 was substituted for the copolymer polycarbonate resin (III-1) of Manufacturing Example 1 used in Example 1.

Comparative Example 3

A photoreceptor was prepared by methods similar to those of Example 1 except that the copolymer polycarbonate resin (III-60) produced in Manufacturing Example 60 was substituted for the copolymer polycarbonate resin (III-1) of Manufacturing Example 1 used in Example 1.

Comparative Example 4

A photoreceptor was prepared by methods similar to those of Example 1 except that the copolymer polycarbonate resin (III-61) produced in Manufacturing Example 61 was substituted for the copolymer polycarbonate resin (III-1) of Manufacturing Example 1 used in Example 1.

Comparative Example 5

A photoreceptor was prepared by methods similar to those of Example 1 except that the copolymer polycarbonate resin (III-62) produced in Manufacturing Example 62 was substituted for the copolymer polycarbonate resin (III-1) of Manufacturing Example 1 used in Example 1.

Comparative Example 6

A photoreceptor was prepared by methods similar to those of Example 1 except that the copolymer polycarbonate resin (III-63) produced in Manufacturing Example 63 was substituted for the copolymer polycarbonate resin (III-1) of Manufacturing Example 1 used in Example 1.

Comparative Example 7

A photoreceptor was prepared by methods similar to those of Example 1 except that the polycarbonate Z (III-64) was substituted for the copolymer polycarbonate resin (III-1) of Manufacturing Example 1 used in Example 1.

Comparative Example 8

A photoreceptor was prepared by methods similar to those of Example 1 except that the polycarbonate A (III-65) was substituted for the copolymer polycarbonate resin (III-1) of Manufacturing Example 1 used in Example 1.

Comparative Example 9

A photoreceptor was prepared by methods similar to those of Example 1 except that the polycarbonate represented by [C 17] in Patent Document 9 (Japanese Patent Application Laid-open No. H5-113670) (hereunder called "III-66") was substituted for the copolymer polycarbonate resin (III-1) of Manufacturing Example 1 used in Example 1.

Manufacture of Monolayer Photoreceptor

Example 62

A coating liquid prepared by agitating and dissolving 0.2 mass parts of a vinyl chloride-vinyl acetate-vinyl alcohol copolymer (Nissin Chemical Solbin™ TA5R) in 99 mass parts of methyl ethyl ketone was dip coated as a base coat layer on the outer circumference of an aluminum cylinder with an outer diameter of 24 mm as a conductive substrate 1, and dried for 30 minutes at 100° C. to form a base coat layer 2 with a thickness of 0.1 μm.

1 mass part of the metal-free phthalocyanine shown by the following formula as a charge generating material,

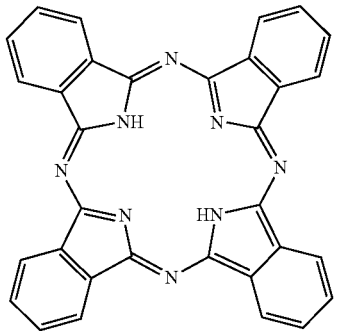

25 mass parts of the stilbene compound represented by the following formula,

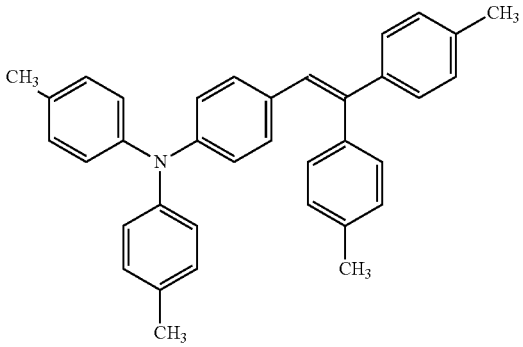

and 20 mass parts of the stilbene compound represented by the following formula as hole transport materials,

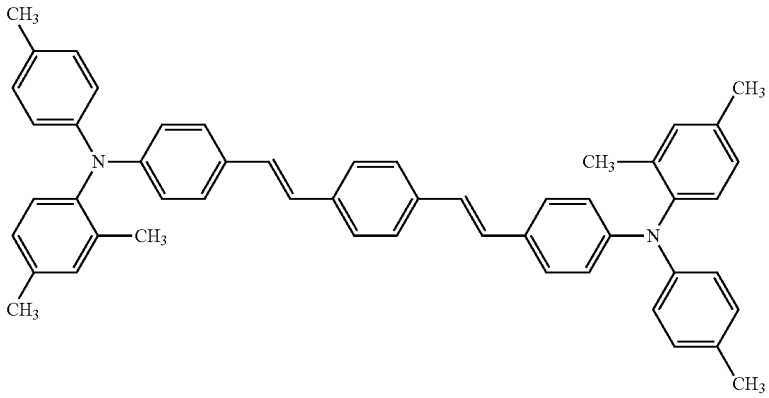

30 mass parts of the compound represented by the following formula as an electron transport material,

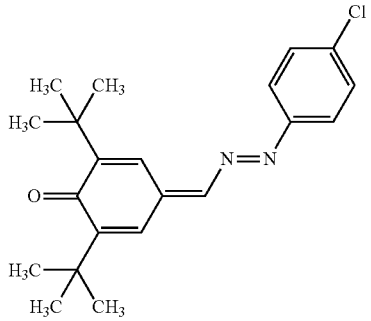

and 55 mass parts of the resin (III-1) of Manufacturing Example 1 above as a resin binder were dissolved and dispersed in 350 mass parts of tetrahydrofuran to prepare a coating liquid, which was then dip coated on the aforementioned base coat layer 2, and dried for 60 minutes at 100° C. to form a photosensitive layer with a thickness of 25 μm, and prepare a monolayer photoreceptor.

Example 63

A photoreceptor was prepared by methods similar to those of Example 62 except that Y-type titanyl phthalocyanine was used instead of the metal-free phthalocyanine used in Example 62.

Example 64

A photoreceptor was prepared by methods similar to those of Example 62 except that α-type titanyl phthalocyanine was used instead of the metal-free phthalocyanine used in Example 62.

Comparative Example 10

A photoreceptor was prepared by methods similar to those of Example 62 except that the copolymer polycarbonate resin (III-58) produced in Manufacturing Example 58 was used instead of the polycarbonate resin (III-1) of Manufacturing Example 1 used in Example 62.

Manufacture of Positively Charged Stacked Photoreceptor

Example 65

50 mass parts of the compound represented by the following formula as a charge transport material,

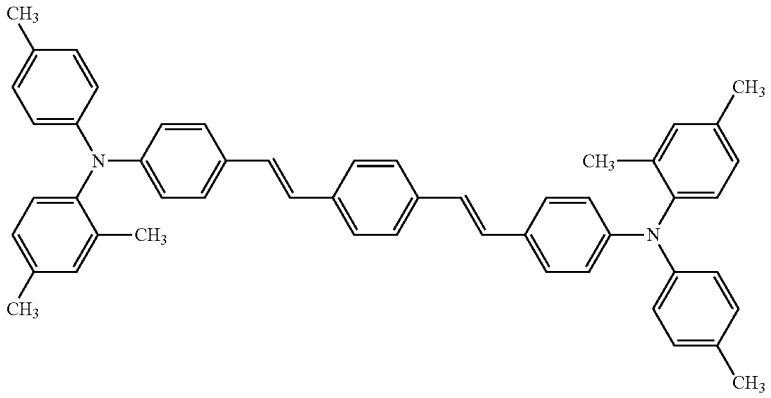

and 50 mass parts of polycarbonate Z (III-64) as a resin binder were dissolved in 800 mass parts of dichloromethane to prepare a coating liquid. This coating liquid was dip coated on the outer circumference of an aluminum cylinder 24 mm in diameter as conductive substrate 1, and dried for 60 minutes at 120° C. to form a charge transport layer with a thickness of 15 μm.

1.5 mass parts of the metal-free phthalocyanine represented by the following formula as a charge generating material,

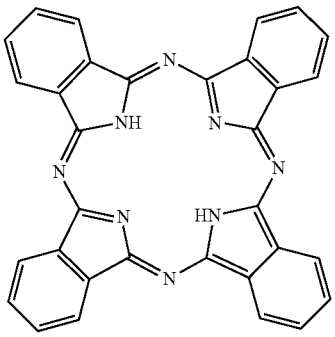

10 mass parts of the stilbene compound represented by the following formula as a hole transport material,

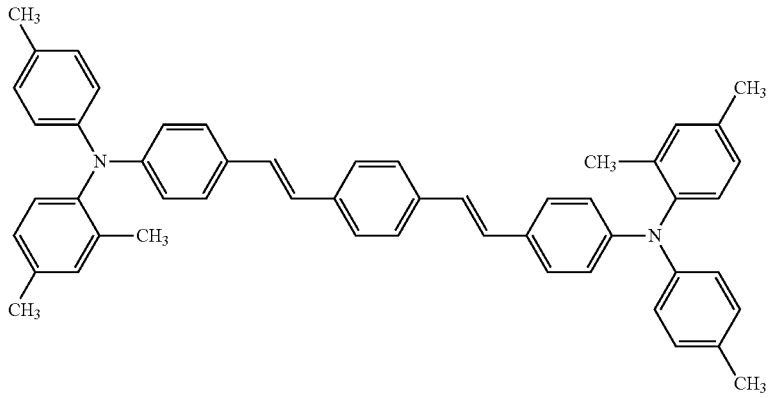

25 mass parts of the compound represented by the following formula as an electron transport material,

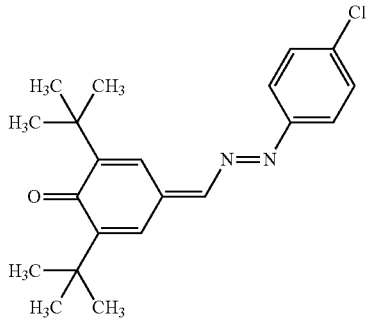

and 60 mass parts of the polycarbonate resin (III-1) of Manufacturing Example 1 as a resin binder were dissolved and dispersed in 800 mass parts of 1,2-dichloroethane to prepare a coating liquid, which was then dip coated on the aforementioned charge transport layer, and dried for 60 minutes at 100° C. to form a photosensitive layer with a thickness of 15 μm, and prepare a positively-charged stacked photoreceptor.

Comparative Example 11

A photoreceptor was prepared by methods similar to those of Example 65 except that the copolymer polycarbonate resin (III-58) produced in Manufacturing Example 58 was used instead of the polycarbonate resin (III-1) of Manufacturing Example 1 used in Example 65.

Evaluation of Photoreceptors

The lubricity and electrical characteristics of the photoreceptors prepared in Examples 1 to 65 and Comparative Examples 1 to 11 above were evaluated by the following methods. The results are shown in the tables below.

Lubricity Evaluation

The lubricity of the surfaces of the photoreceptors prepared in the aforementioned Examples and Comparative Examples was measured using a surface property tester (Heidon Surface Tester Type 14FW). For the photoreceptors of Examples 1 to 61 and Comparative Examples 1 to 9, the photoreceptor was mounted on an HP LJ4250 printer, 10,000 sheets of A4 paper were printed, and the lubricity of the photoreceptor after printing was evaluated. For Examples 62 to 65 and Comparative Examples 10 and 11, the photoreceptor was mounted on a Brother HL-2040 printer, 10,000 sheets of A4 paper were printed, and the lubricity of the photoreceptor after printing was evaluated. For the measurements, a urethane rubber blade was pushed against the photoreceptor surface under a constant load of 20 g, the blade was moved in the lengthwise direction of the photoreceptor to produce friction, and the load was measured as frictional force.

Electrical Characteristics

For Examples 1 to 61 and Comparative Examples 1 to 9, the surface of the photoreceptor was charged at −650 V by corona discharge in a dark place under environment of a temperature of 22° C. and a humidity of 50%, and the surface potential $V_0$ immediately after charging was measured. This was left for 5 seconds in a dark place, the surface potential $V_5$ was measured, and the potential retention rate $Vk_5$(%) 5 seconds after charging was determined according to the following Formula (1):

$$Vk_5 = V_5/V_0 \times 100 \quad (1).$$

Once the surface potential of the photoreceptor reached −600 V, it was exposed for 5 seconds to 1.0 μW/cm$^2$ of exposure light from a halogen lamp light source dispersed to 780 nm with a filter, and the amount of exposure required for the surface potential to decay to −300 V was evaluated as $E_{1/2}$ (μJ/cm$^2$), and the residual potential on the photoreceptor surface 5 seconds after exposure as Vr5 (V). For Examples 62 to 65 and Comparative Examples 10 and 11, the evaluation was the same except that the charge was +650 V, exposure was started at a surface potential of +600 V, and $E_{1/2}$ was the amount of exposure required to reach +300 V.

Equipment Characteristics

The photoreceptors of Examples 1 to 61 and Comparative Examples 1 to 9 were mounted on an HP LJ4250 printer that had been modified so that the surface potential of the photoreceptor could be measured, and the exposure unit potential was evaluated. 10,000 sheets of A4 paper were printed, the thickness of the photoreceptor was measured before and after printing, and the amount of wear (μm) after printing was evaluated. For the photoreceptors prepared in Examples 62 to 65 and Comparative Examples 10 and 11, the photoreceptors were mounted on a Brother HL-2040 printer that had been modified so that the surface potential of the photoreceptor could be measured, and the exposure unit potential was evaluated. 10,000 sheets of A4 paper were also printed, the thickness of the photoreceptor was measured after printing, and the amount of wear (μm) after printing was evaluated.

Solvent Cracking Resistance 10 sheets each were printed using the photoreceptors prepared in Examples 1 to 65 and Comparative Examples 1 to 11 under the same conditions used for evaluating the equipment characteristics, and each photoreceptor was immersed in kerosene for 60 minutes. White paper was then printed again under the same conditions, and the presence or absence of printing defects (black streaks) caused by cracks was confirmed. O means that there were black smudges on the image, while x means there were none.

TABLE 7

| | Resin | Polymer ratio (mol %) a | b | Charge | $Vk_5$ (%) | $E_{1/2}$ ($\mu J/cm^2$) | Vr5 (−V) | Printer exposure unit potential (−V) |
|---|---|---|---|---|---|---|---|---|
| Ex 1 | (III-1) | 1.000 | 99.000 | Neg | 94 | 0.13 | 19 | 129 |
| Ex 2 | (III-2) | 2.000 | 98.000 | Neg | 96 | 0.12 | 15 | 120 |
| Ex 3 | (III-3) | 10.000 | 90.000 | Neg | 95 | 0.13 | 17 | 125 |
| Ex 4 | (III-4) | 0.100 | 99.900 | Neg | 95 | 0.13 | 16 | 128 |
| Ex 5 | (III-5) | 0.010 | 99.990 | Neg | 95 | 0.12 | 18 | 131 |
| Ex 6 | (III-6) | 1.000 | 99.000 | Neg | 96 | 0.13 | 14 | 115 |
| Ex 7 | (III-7) | 2.000 | 98.000 | Neg | 94 | 0.15 | 19 | 130 |
| Ex 8 | (III-8) | 0.100 | 99.900 | Neg | 95 | 0.14 | 20 | 129 |
| Ex 9 | (III-9) | 0.010 | 99.990 | Neg | 96 | 0.13 | 13 | 120 |
| Ex 10 | (III-10) | 1.000 | 99.000 | Neg | 96 | 0.12 | 14 | 113 |
| Ex 11 | (III-11) | 2.000 | 98.000 | Neg | 95 | 0.13 | 15 | 119 |
| Ex 12 | (III-12) | 0.010 | 99.990 | Neg | 94 | 0.13 | 17 | 123 |
| Ex 13 | (III-13) | 0.100 | 99.900 | Neg | 95 | 0.13 | 20 | 135 |
| Ex 14 | (III-14) | 1.000 | 99.000 | Neg | 96 | 0.13 | 21 | 134 |
| Ex 15 | (III-15) | 2.000 | 98.000 | Neg | 94 | 0.13 | 23 | 133 |
| Ex 16 | (III-16) | 0.010 | 99.990 | Neg | 94 | 0.13 | 18 | 129 |
| Ex 17 | (III-17) | 0.100 | 99.900 | Neg | 96 | 0.13 | 19 | 133 |
| Ex 18 | (III-18) | 1.000 | 99.000 | Neg | 95 | 0.13 | 23 | 130 |
| Ex 19 | (III-19) | 2.000 | 98.000 | Neg | 96 | 0.13 | 24 | 134 |
| Ex 20 | (III-20) | 0.010 | 99.990 | Neg | 95 | 0.15 | 18 | 124 |
| Ex 21 | (III-21) | 0.100 | 99.900 | Neg | 95 | 0.15 | 18 | 123 |
| Ex 22 | (III-22) | 1.000 | 99.000 | Neg | 95 | 0.16 | 24 | 125 |
| Ex 23 | (III-23) | 0.100 | 99.900 | Neg | 94 | 0.13 | 21 | 120 |
| Ex 24 | (III-24) | 0.010 | 99.990 | Neg | 94 | 0.12 | 14 | 114 |
| Ex 25 | (III-25) | 0.001 | 99.999 | Neg | 96 | 0.13 | 14 | 116 |

TABLE 8

| | Resin | Polymer ratio (mol %) a | b | Charge | $Vk_5$ (%) | $E_{1/2}$ ($\mu J/cm^2$) | Vr5 (−V) | Printer exposure unit potential (−V) |
|---|---|---|---|---|---|---|---|---|
| Ex 26 | (III-26) | 0.100 | 99.900 | Neg | 96 | 0.24 | 19 | 134 |
| Ex 27 | (III-27) | 0.100 | 99.900 | Neg | 94 | 0.13 | 16 | 112 |
| Ex 28 | (III-28) | 0.100 | 99.900 | Neg | 95 | 0.13 | 18 | 120 |
| Ex 29 | (III-29) | 0.100 | 99.900 | Neg | 94 | 0.28 | 14 | 125 |
| Ex 30 | (III-30) | 0.100 | 99.900 | Neg | 94 | 0.23 | 19 | 136 |
| Ex 31 | (III-31) | 0.100 | 99.900 | Neg | 96 | 0.11 | 15 | 120 |
| Ex 32 | (III-32) | 0.100 | 99.900 | Neg | 96 | 0.22 | 18 | 132 |
| Ex 33 | (III-33) | 0.100 | 99.900 | Neg | 96 | 0.18 | 17 | 128 |
| Ex 34 | (III-34) | 0.100 | 99.900 | Neg | 93 | 0.20 | 20 | 134 |
| Ex 35 | (III-35) | 0.100 | 99.900 | Neg | 95 | 0.18 | 19 | 133 |
| Ex 36 | (III-36) | 0.100 | 99.900 | Neg | 96 | 0.16 | 19 | 130 |
| Ex 37 | (III-37) | 0.100 | 99.900 | Neg | 95 | 0.20 | 18 | 129 |
| Ex 38 | (III-38) | 0.100 | 99.900 | Neg | 96 | 0.17 | 17 | 125 |
| Ex 39 | (III-39) | 0.100 | 99.900 | Neg | 94 | 0.21 | 19 | 134 |
| Ex 40 | (III-40) | 0.100 | 99.900 | Neg | 96 | 0.16 | 17 | 131 |
| Ex 41 | (III-41) | 0.100 | 99.900 | Neg | 96 | 0.14 | 18 | 130 |
| Ex 42 | (III-42) | 0.100 | 99.900 | Neg | 95 | 0.18 | 20 | 132 |
| Ex 43 | (III-43) | 0.100 | 99.900 | Neg | 96 | 0.17 | 17 | 130 |
| Ex 44 | (III-44) | 0.100 | 99.900 | Neg | 97 | 0.15 | 16 | 125 |
| Ex 45 | (III-45) | 0.100 | 99.900 | Neg | 96 | 0.23 | 20 | 130 |
| Ex 46 | (III-46) | 0.100 | 99.900 | Neg | 94 | 0.23 | 21 | 133 |
| Ex 47 | (III-47) | 0.100 | 99.900 | Neg | 96 | 0.22 | 22 | 135 |
| Ex 48 | (III-48) | 0.100 | 99.900 | Neg | 94 | 0.25 | 20 | 130 |

TABLE 9

| | Resin | Polymer ratio (mol %) a | b | Charge | $Vk_5$ (%) | $E_{1/2}$ ($\mu J/cm^2$) | Vr5 (−V) | Printer exposure unit potential (−V) |
|---|---|---|---|---|---|---|---|---|
| Ex 49 | (III-49) | 0.100 | 99.900 | Neg | 96 | 0.28 | 20 | 135 |
| Ex 50 | (III-50) | 0.100 | 99.900 | Neg | 96 | 0.27 | 21 | 134 |

TABLE 9-continued

| | Resin | Polymer ratio (mol %) a | b | Charge | $Vk_5$ (%) | $E_{1/2}$ (μJ/cm$^2$) | Vr5 (−V) | Printer exposure unit potential (−V) |
|---|---|---|---|---|---|---|---|---|
| Ex 51 | (III-51) | 0.100 | 99.900 | Neg | 95 | 0.25 | 22 | 136 |
| Ex 52 | (III-52) | 0.100 | 99.900 | Neg | 95 | 0.19 | 23 | 130 |
| Ex 53 | (III-53) | 0.100 | 99.900 | Neg | 96 | 0.19 | 24 | 132 |
| Ex 54 | (III-54) | 0.100 | 99.900 | Neg | 95 | 0.21 | 22 | 124 |
| Ex 55 | (III-55) | 0.100 | 99.900 | Neg | 96 | 0.20 | 19 | 131 |
| Ex 56 | (III-56) | 0.100 | 99.900 | Neg | 96 | 0.18 | 18 | 129 |
| Ex 57 | (III-57) | 0.100 | 99.900 | Neg | 96 | 0.22 | 19 | 129 |
| Ex 58 | (III-1) | 1.000 | 99.000 | Neg | 94 | 0.23 | 23 | 130 |
| Ex 59 | (III-1) | 1.000 | 99.000 | Neg | 95 | 0.10 | 10 | 105 |
| Ex 60 | (III-1, III-64) | 1.000 | 99.000 | Neg | 96 | 0.15 | 19 | 135 |
| Ex 61 | (III-1, III-65) | 1.000 | 99.000 | Neg | 94 | 0.15 | 18 | 137 |
| CE 1 | (III-58) | 0.000 | 100.000 | Neg | 94 | 0.21 | 23 | 130 |
| CE 2 | (III-59) | 0.000 | 100.000 | Neg | 94 | 0.19 | 25 | 120 |
| CE 3 | (III-60) | 0.000 | 100.000 | Neg | 95 | 0.22 | 20 | 125 |
| CE 4 | (III-61) | 0.000 | 100.000 | Neg | 95 | 0.23 | 18 | 125 |
| CE 5 | (III-62) | 0.000 | 100.000 | Neg | 95 | 0.22 | 18 | 124 |
| CE 6 | (III-63) | 0.000 | 100.000 | Neg | 95 | 0.22 | 22 | 136 |
| CE 7 | (III-64) | — | — | Neg | 94 | 0.12 | 19 | 128 |
| CE 8 | (III-65) | — | — | Neg | 95 | 0.13 | 23 | 135 |
| CE 9 | (III-66) | — | — | Neg | 94 | 0.29 | 31 | 190 |

TABLE 10

| | Resin | Polymer ratio (mol %) a | b | Charge | $Vk_5$ (%) | $E_{1/2}$ (μJ/cm$^2$) | Vr5 (−V) | Printer exposure unit potential (−V) |
|---|---|---|---|---|---|---|---|---|
| Ex 62 | (III-1) | 1.000 | 99.000 | Pos mono | 86 | 0.33 | 33 | 135 |
| Ex 63 | (III-1) | 1.000 | 99.000 | Pos mono | 83 | 0.19 | 21 | 106 |
| Ex 64 | (III-1) | 1.000 | 99.000 | Pos mono | 84 | 0.29 | 26 | 118 |
| CE 10 | (III-58) | 0.000 | 100.000 | Pos mono | 85 | 0.31 | 36 | 140 |
| Ex 65 | (III-1) | 1.000 | 99.000 | Pos stacked | 84 | 0.23 | 23 | 118 |
| CE 11 | (III-58) | 0.000 | 100.000 | Pos stacked | 85 | 0.26 | 26 | 118 |

TABLE 11

| | Resin | Polymer ratio (mol %) a | b | Lubricity before after printing (dynamic friction coefficient) before | after | Printed image | Solvent crack resistance | Wear after printing (μm) |
|---|---|---|---|---|---|---|---|---|
| Ex 1 | (III-1) | 1.000 | 99.000 | 0.45 | 0.81 | Good | ○ | 2.8 |
| Ex 2 | (III-2) | 2.000 | 98.000 | 0.41 | 0.79 | Good | ○ | 2.5 |
| Ex 3 | (III-3) | 10.000 | 90.000 | 0.33 | 0.88 | Good | ○ | 2.2 |
| Ex 4 | (III-4) | 0.100 | 99.900 | 0.55 | 0.78 | Good | ○ | 2.9 |
| Ex 5 | (III-5) | 0.010 | 99.990 | 0.61 | 0.89 | Good | ○ | 3.0 |
| Ex 6 | (III-6) | 1.000 | 99.000 | 0.49 | 0.92 | Good | ○ | 2.4 |
| Ex 7 | (III-7) | 2.000 | 98.000 | 0.39 | 0.63 | Good | ○ | 2.2 |
| Ex 8 | (III-8) | 0.100 | 99.900 | 0.51 | 0.65 | Good | ○ | 2.3 |
| Ex 9 | (III-9) | 0.010 | 99.990 | 0.62 | 0.71 | Good | ○ | 2.8 |
| Ex 10 | (III-10) | 1.000 | 99.000 | 0.51 | 0.82 | Good | ○ | 2.9 |
| Ex 11 | (III-11) | 2.000 | 98.000 | 0.32 | 0.89 | Good | ○ | 2.7 |
| Ex 12 | (III-12) | 0.010 | 99.990 | 0.55 | 0.92 | Good | ○ | 3.0 |
| Ex 13 | (III-13) | 0.100 | 99.900 | 0.53 | 0.75 | Good | ○ | 2.9 |
| Ex 14 | (III-14) | 1.000 | 99.000 | 0.41 | 0.82 | Good | ○ | 2.6 |
| Ex 15 | (III-15) | 2.000 | 98.000 | 0.30 | 0.83 | Good | ○ | 2.5 |
| Ex 16 | (III-16) | 0.010 | 99.990 | 0.45 | 0.69 | Good | ○ | 2.3 |
| Ex 17 | (III-17) | 0.100 | 99.900 | 0.39 | 0.73 | Good | ○ | 2.2 |
| Ex 18 | (III-18) | 1.000 | 99.000 | 0.35 | 0.78 | Good | ○ | 2.6 |
| Ex 19 | (III-19) | 2.000 | 98.000 | 0.31 | 0.85 | Good | ○ | 3.1 |
| Ex 20 | (III-20) | 0.010 | 99.990 | 0.51 | 0.64 | Good | ○ | 2.9 |
| Ex 21 | (III-21) | 0.100 | 99.900 | 0.47 | 0.62 | Good | ○ | 2.6 |
| Ex 22 | (III-22) | 1.000 | 99.000 | 0.29 | 0.61 | Good | ○ | 2.2 |
| Ex 23 | (III-23) | 0.100 | 99.900 | 0.35 | 0.78 | Good | ○ | 2.5 |
| Ex 24 | (III-24) | 0.010 | 99.990 | 0.44 | 0.82 | Good | ○ | 3.0 |
| Ex 25 | (III-25) | 0.001 | 99.999 | 0.51 | 0.80 | Good | ○ | 3.1 |

TABLE 12

| | Resin | Polymer ratio (mol %) a | Polymer ratio (mol %) b | Lubricity before/after printing (dynamic friction coefficient) before | Lubricity before/after printing (dynamic friction coefficient) after | Printed image | Solvent crack resistance | Wear after printing (μm) |
|---|---|---|---|---|---|---|---|---|
| Ex 26 | (III-26) | 0.100 | 99.900 | 0.38 | 0.75 | Good | ○ | 1.9 |
| Ex 27 | (III-27) | 0.100 | 99.900 | 0.46 | 0.78 | Good | ○ | 1.9 |
| Ex 28 | (III-28) | 0.100 | 99.900 | 0.41 | 0.82 | Good | ○ | 2.3 |
| Ex 29 | (III-29) | 0.100 | 99.900 | 0.48 | 0.79 | Good | ○ | 1.8 |
| Ex 30 | (III-30) | 0.100 | 99.900 | 0.42 | 0.83 | Good | ○ | 2.4 |
| Ex 31 | (III-31) | 0.100 | 99.900 | 0.43 | 0.79 | Good | ○ | 2.1 |
| Ex 32 | (III-32) | 0.100 | 99.900 | 0.42 | 0.80 | Good | ○ | 2.0 |
| Ex 33 | (III-33) | 0.100 | 99.900 | 0.43 | 0.78 | Good | ○ | 2.1 |
| Ex 34 | (III-34) | 0.100 | 99.900 | 0.45 | 0.77 | Good | ○ | 1.8 |
| Ex 35 | (III-35) | 0.100 | 99.900 | 0.42 | 0.82 | Good | ○ | 2.0 |
| Ex 36 | (III-36) | 0.100 | 99.900 | 0.44 | 0.79 | Good | ○ | 2.0 |
| Ex 37 | (III-37) | 0.100 | 99.900 | 0.43 | 0.81 | Good | ○ | 2.3 |
| Ex 38 | (III-38) | 0.100 | 99.900 | 0.43 | 0.80 | Good | ○ | 2.1 |
| Ex 39 | (III-39) | 0.100 | 99.900 | 0.42 | 0.82 | Good | ○ | 2.4 |
| Ex 40 | (III-40) | 0.100 | 99.900 | 0.47 | 0.84 | Good | ○ | 2.1 |
| Ex 41 | (III-41) | 0.100 | 99.900 | 0.40 | 0.81 | Good | ○ | 2.0 |
| Ex 42 | (III-42) | 0.100 | 99.900 | 0.44 | 0.76 | Good | ○ | 2.1 |
| Ex 43 | (III-43) | 0.100 | 99.900 | 0.42 | 0.77 | Good | ○ | 2.1 |
| Ex 44 | (III-44) | 0.100 | 99.900 | 0.43 | 0.79 | Good | ○ | 2.1 |
| Ex 45 | (III-45) | 0.100 | 99.900 | 0.40 | 0.77 | Good | ○ | 2.1 |
| Ex 46 | (III-46) | 0.100 | 99.900 | 0.42 | 0.80 | Good | ○ | 1.9 |
| Ex 47 | (III-47) | 0.100 | 99.900 | 0.44 | 0.78 | Good | ○ | 1.8 |
| Ex 48 | (III-48) | 0.100 | 99.900 | 0.40 | 0.76 | Good | ○ | 1.9 |

TABLE 13

| | Resin | Polymer ratio (mol %) a | Polymer ratio (mol %) b | Lubricity before/after printing (dynamic friction coefficient) before | Lubricity before/after printing (dynamic friction coefficient) after | Printed image | Solvent crack resistance | Wear after printing (μm) |
|---|---|---|---|---|---|---|---|---|
| Ex 49 | (III-49) | 0.100 | 99.900 | 0.40 | 0.80 | Good | ○ | 2.4 |
| Ex 50 | (III-50) | 0.100 | 99.900 | 0.40 | 0.76 | Good | ○ | 2.5 |
| Ex 51 | (III-51) | 0.100 | 99.900 | 0.41 | 0.80 | Good | ○ | 2.3 |
| Ex 52 | (III-52) | 0.100 | 99.900 | 0.45 | 0.76 | Good | ○ | 2.4 |
| Ex 53 | (III-53) | 0.100 | 99.900 | 0.44 | 0.76 | Good | ○ | 2.1 |
| Ex 54 | (III-54) | 0.100 | 99.900 | 0.44 | 0.79 | Good | ○ | 2.2 |
| Ex 55 | (III-55) | 0.100 | 99.900 | 0.46 | 0.86 | Good | ○ | 2.2 |
| Ex 56 | (III-56) | 0.100 | 99.900 | 0.42 | 0.88 | Good | ○ | 2.0 |
| Ex 57 | (III-57) | 0.100 | 99.900 | 0.49 | 0.84 | Good | ○ | 2.1 |
| Ex 58 | (III-1) | 1.000 | 99.000 | 0.42 | 0.74 | Good | ○ | 2.8 |
| Ex 59 | (III-1) | 1.000 | 99.000 | 0.43 | 0.81 | Good | ○ | 2.9 |
| Ex 60 | (III-1, III-64) | 1.000 | 99.000 | 0.39 | 0.76 | Good | ○ | 2.2 |
| Ex 61 | (III-1, III-65) | 1.000 | 99.000 | 0.38 | 0.75 | Good | ○ | 3.3 |
| CE 1 | (III-58) | 0.000 | 100.000 | 2.83 | 3.05 | Lower concentration, streaky image defects | X | 5.0 |
| CE 2 | (III-59) | 0.000 | 100.000 | 2.85 | 3.01 | Good | X | 3.5 |
| CE 3 | (III-60) | 0.000 | 100.000 | 2.91 | 3.10 | Streaky image defects | X | 3.0 |
| CE 4 | (III-61) | 0.000 | 100.000 | 2.96 | 3.05 | Streaky image defects | X | 3.9 |
| CE 5 | (III-62) | 0.000 | 100.000 | 2.90 | 3.21 | Good | X | 2.5 |
| CE 6 | (III-63) | 0.000 | 100.000 | 2.99 | 3.21 | Streaky image defects | X | 4.2 |
| CE 7 | (III-64) | — | — | 2.85 | 3.11 | Good | X | 3.4 |
| CE 8 | (III-65) | — | — | 2.89 | 3.21 | Lower concentration, streaky image defects | X | 4.9 |
| CE 9 | (III-66) | — | — | 0.80 | 1.50 | Lower concentration, streaky image defects | X | 3.6 |

TABLE 14

| | Resin | Polymer ratio mol % a | Polymer ratio mol % b | Lubricity before/after printing (dynamic friction coefficient) before | Lubricity after | Printed image | Solvent crack resistance | Wear after printing (μm) |
|---|---|---|---|---|---|---|---|---|
| Ex 62 | (III-1) | 1.000 | 99.000 | 0.49 | 0.77 | Good | ○ | 2.1 |
| Ex 63 | (III-1) | 1.000 | 99.000 | 0.50 | 0.78 | Good | ○ | 2.4 |
| Ex 64 | (III-1) | 1.000 | 99.000 | 0.53 | 0.81 | Good | ○ | 2.2 |
| CE 10 | (III-58) | 0.000 | 100.000 | 2.86 | 3.10 | Streaky image defects | X | 4.0 |
| Ex 65 | (III-1) | 1.000 | 99.000 | 0.53 | 0.80 | Good | ○ | 2.2 |
| CE 11 | (III-58) | 0.000 | 100.000 | 2.95 | 3.17 | Streaky image defects | X | 3.9 |

The results in the tables above show that photoreceptors exhibiting good characteristics were obtained in Examples 1 to 65, with low friction coefficients initially and after actual printing and without sacrificing the electrical characteristics of the photoreceptor. Moreover, the photoreceptors of Examples 1 to 65 exhibited good solvent crack resistance, and less wear after printing than photoreceptors using other resins containing no siloxane component. On the other hand, the photoreceptors of the Comparative Examples, which contained no siloxane component, exhibited large friction coefficients, and in some cases the printed images exhibited streaky image defects and lower printing concentration. The photoreceptors of Comparative Examples 1 to 8, and 11 had no problems of electrical characteristics, but could not achieve both a low friction coefficient and low wear. The photoreceptor of Comparative Example 9 had no problem of the initial friction coefficient, but the friction coefficient was somewhat high after printing, solvent crack resistance was poor, and streaky image defects were confirmed, and were attributed to stress relaxation in the film.

Thus, it was confirmed that an electrophotographic photoreceptor with a low friction coefficient and little wear can be obtained without sacrificing electrical characteristics by using the copolymer polycarbonate resin of the present invention.

The invention claimed is:

1. An electrophotographic photoreceptor, comprising:

a conductive substrate; and a photosensitive layer provided on the conductive substrate and containing a resin binder that is a polycarbonate resin having structural units represented by General Formulae (1) and (2) below:

(1)

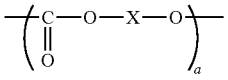

(2)

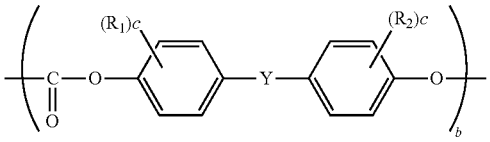

where, in General Formula (1), X is General Formula (3) or (4) below, and the polycarbonate resin may contain, as structural units represented by General Formula (1), both units in which X is General Formula (3) below and units in which X is General Formula (4) below:

(3)

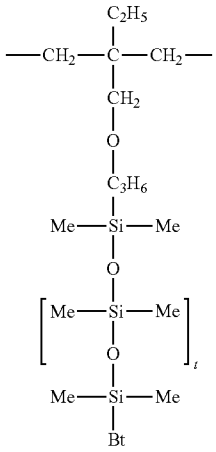

(4)

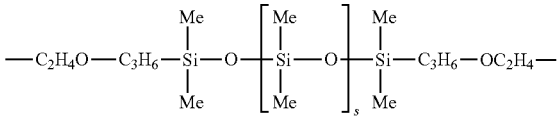

where t and s in General Formulae (3) and (4) are each an integer of 1 or greater;

where, in General Formula (2), $R_1$ and $R_2$ may be the same or different, and are hydrogen atoms, $C_{1-12}$ alkyl groups, halogen atoms, $C_{6-12}$ optionally substituted aryl groups or $C_{1-12}$ alkoxy groups, c is an integer from 0 to 4, and Y is a single bond, —O—, —S—, —SO—, —CO—, —$SO_2$—, or —$CR_3R_4$— (in which $R_3$ and $R_4$ may be the same or different, and are hydrogen atoms, $c_{1-12}$ alkyl groups, halogenated alkyl groups or $C_{6-12}$ optionally substituted aryl groups), or $C_{5-12}$ optionally substituted cycloalkylidene group, $C_{2-12}$ optionally substituted α,ω-alkylene group, -9,9-fluorenylidene group, $C_{6-12}$ optionally substituted arylene group, a bivalent group including $C_{6-12}$ aryl group or arylene group; and a and b are the respective molar percentages of structural units (1) and (2) relative to the total number of moles of structural units (1) and (2).

2. The electrophotographic photoreceptor according to claim 1, wherein a in General Formula (1) above is 0.001 to 10 mol %.

3. The electrophotographic photoreceptor according to claim 1, wherein $R_1$ and $R_2$ in General Formula (2) above are each independently a hydrogen atom or a methyl group, Y is —$CR_3R_4$—, and $R_3$ and $R_4$ are each independently a hydrogen atom or a methyl group.

4. The electrophotographic photoreceptor according to claim 1, wherein $R_1$ and $R_2$ in General Formula (2) above are each independently a hydrogen atom or a methyl group, and Y is a cyclohexylidene group.

5. The electrophotographic photoreceptor according to claim 1, wherein $R_1$ and $R_2$ in General Formula (2) above are each independently a hydrogen atom or a methyl group, and Y is a single bond.

6. The electrophotographic photoreceptor according to claim 1, wherein $R_1$ and $R_2$ in General Formula (2) above are each independently a hydrogen atom or a methyl group, Y is —$CR_3R_4$—, and $R_3$ and $R_4$ are a methyl group and an ethyl group, respectively.

7. The electrophotographic photoreceptor according to claim 1, wherein $R_1$ and $R_2$ in General Formula (2) above are each independently a hydrogen atom or a methyl group, and Y is a 9,9-fluorenylidene group.

8. The electrophotographic photoreceptor according to claim 1, wherein the polycarbonate resin is a copolymer containing two or more of a structural unit represented by General Formula (2) above in which $R_1$ and $R_2$ are each independently a hydrogen atom or a methyl group, Y is —$CR_3R_4$—, and $R_3$ and $R_4$ are each independently a hydrogen atom or a methyl group, a structural unit represented by General Formula (2) above in which $R_1$ and $R_2$ are each independently a hydrogen atom or a methyl group and Y is a cyclohexylidene group, a structural unit represented by General Formula (2) above in which $R_1$ and $R_2$ are each independently a hydrogen atom or a methyl group, and Y is a single bond, a structural unit represented by General Formula (2) above in which $R_1$ and $R_2$ are each independently a hydrogen atom or a methyl group, Y is —$CR_3R_4$—, and $R_3$ and $R_4$ are a methyl group and an ethyl group, respectively, and a structural unit represented by General Formula (2) above in which $R_1$ and $R_2$ are each independently a hydrogen atom or a methyl group, and Y is a -9,9-fluorenylidene group.

9. A method for manufacturing the electrophotographic photoreceptor according to claim 1, comprising:

applying a coating liquid containing at least said resin binder onto a conductive substrate to thereby form a photosensitive layer.

10. An electrophotographic device equipped with the electrophotographic photoreceptor according to claim 1.

* * * * *